US006422674B1

(12) United States Patent
Hinami et al.

(10) Patent No.: US 6,422,674 B1
(45) Date of Patent: Jul. 23, 2002

(54) LIQUID SUPPLY SYSTEM AND LIQUID RESIDUAL AMOUNT DETECTING METHOD OF LIQUID SUPPLY SYSTEM

(75) Inventors: Jun Hinami, Yokohama; Shozo Hattori, Tokyo; Hajime Yamamoto; Eiichiro Shimizu, both of Yokohama; Hidehisa Matsumoto; Hiroki Hayashi, both of Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/469,218

(22) Filed: Dec. 22, 1999

(30) Foreign Application Priority Data

Dec. 24, 1998 (JP) ..... 10-368064

(51) Int. Cl.[7] ..... B41J 2/195; B41J 2/175

(52) U.S. Cl. ..... 347/7; 347/85; 347/86

(58) Field of Search ..... 347/7, 19, 23, 347/6, 84, 85, 86, 30

(56) References Cited

U.S. PATENT DOCUMENTS

| | | | | |
|---|---|---|---|---|
| 4,628,332 A | | 12/1986 | Matsumoto | 346/140 R |
| 5,400,066 A | | 3/1995 | Matsumoto et al. | 347/86 |
| 5,500,665 A | | 3/1996 | Ujita et al. | 347/86 |
| 5,509,140 A | | 4/1996 | Koitabashi et al. | 347/86 |
| 5,567,373 A | | 10/1996 | Sato et al. | 264/112 |
| 5,619,239 A | | 4/1997 | Kotaki et al. | 347/86 |
| 5,689,290 A | * | 11/1997 | Saito et al. | 347/7 |
| 5,742,311 A | | 4/1998 | Koitabashi et al. | 347/86 |
| 5,815,184 A | | 9/1998 | Ujita et al. | 347/89 |
| 5,831,652 A | | 11/1998 | Hinami et al. | 347/86 |
| 5,852,457 A | | 12/1998 | Kotaki et al. | 347/86 |
| 5,949,456 A | | 9/1999 | Matsumoto et al. | 347/85 |
| 5,980,031 A | | 11/1999 | Sasaki et al. | 347/85 |
| 6,062,667 A | | 5/2000 | Matsui et al. | 347/19 |
| 6,234,618 B1 | | 5/2001 | Yamamoto et al. | 347/86 |
| 6,247,806 B1 | | 6/2001 | Matsumoto et al. | 347/87 |
| 6,270,206 B1 | | 8/2001 | Shimizu et al. | 347/86 |
| 6,290,345 B1 | | 9/2001 | Sasaki et al. | 347/86 |
| 6,305,794 B1 | | 10/2001 | Sasaki et al. | 347/86 |
| 6,328,437 B1 | | 12/2001 | Mihara et al. | 347/86 |

FOREIGN PATENT DOCUMENTS

| | | | |
|---|---|---|---|
| DE | 3408302 | 9/1985 | |
| EP | 0 058 531 | 8/1982 | 347/14 |
| EP | 0 580 433 | 1/1994 | 347/7 |
| EP | 581531 | 2/1994 | |
| EP | 738605 | 10/1996 | |
| EP | 0 738 605 | 10/1996 | 347/19 |
| EP | 925935 | 6/1999 | |
| JP | 10-175311 | 6/1998 | 347/7 |

* cited by examiner

*Primary Examiner*—John Barlow
*Assistant Examiner*—Charles W. Stewart, Jr.
(74) *Attorney, Agent, or Firm*—Fitzpatrick, Cella, Harper & Scinto

(57) ABSTRACT

There is disclosed a liquid supply system comprises a negative pressure generating member containing chamber provided with a liquid supply portion for supply liquid to the outside and an atmosphere connecting portion for connecting with atmosphere for containing a negative pressure generating member holding the liquid inside, a liquid containing chamber connected to the negative pressure generating member containing chamber, forming a sealed space except the connection, and having a liquid containing portion which can generate a negative pressure by deformation, and liquid residual amount detecting means for detecting a liquid level position of the liquid in the liquid containing portion to detect a liquid residual amount in the liquid containing portion. Since the liquid residual amount can be known, a user can know the time to exchange the liquid containing chamber. Moreover, by detecting the liquid state in the liquid containing portion, more stable liquid supply operation can be realized.

17 Claims, 22 Drawing Sheets

LIQUID SUPPLY SYSTEM AND LIQUID RESIDUAL AMOUNT DETECTING METHOD OF LIQUID SUPPLY SYSTEM

BACKGROUND OF THE INVENTION

1. Field of the Invention

The present invention relates to a liquid supply system which uses a negative pressure to supply liquid to the outside, particularly to a liquid supply system in which the residual amount of liquid in a liquid container can be detected, and an ink jet recording apparatus.

2. Related Background Art

As a conventional liquid supply method in which a negative pressure is utilized to supply liquid to the outside, for example, an ink tank which gives the negative pressure to an ink discharge head has been proposed in an ink jet recording apparatus field, and a constitution (head cartridge) which can integrally be formed with a recording head has been implemented. Specifically, the head cartridge can further be classified to a constitution in which the recording and an ink tank (ink container) are constantly integrally constituted, and a constitution in which recording means is separate from the ink container, both can also be separated from a recording apparatus, and they are integrally combined during operation.

As one of easiest methods for generating the negative pressure in such liquid supply system, there is a method of utilizing the capillary force of a porous material. The ink tank in this method is constituted of a sponge or another porous material contained, preferably compressed/contained entirely in the ink tank for a purpose of ink storage, and an atmosphere connecting port via which air can be taken into the ink container to smooth the ink supply during printing.

However, as a problem when the porous member is used as an ink holding member, the ink containing efficiency per unit volume is low. To solve the problem, the present applicant has proposed an ink tank in the publication of EP0580433 in which the whole excluding a connecting portion to a negative pressure generating member containing chamber has a substantially sealed ink containing chamber and the negative pressure generating member containing chamber is opened to the atmosphere during operation. Moreover, in the publication of EP058531, for the ink tank structured as described above, the invention for a changeable ink containing chamber has been proposed.

In the above-described ink tank, since ink is supplied to the negative pressure generating member containing chamber from the ink containing chamber by a gas-liquid replacing operation of containing gas in the ink containing chamber with the introducing of the ink in the ink containing chamber, the ink can advantageously be supplied under a substantially constant negative pressure condition during this gas-liquid replacing operation.

Furthermore, in the publication of EP0738605, the present applicant has proposed a liquid container which comprises a substantially polygon columnar housing, and a containing portion which has the shape of an outer surface equal to or complementary to that of the inner surface of the housing and which can be deformed when the liquid contained inside is guided to the outside. For the thickness of the containing portion, the portion constituting a corner portion of each surface of the substantially polygon columnar shape set to be thinner than the center region thereof. In this liquid container, when the containing portion is appropriately contracted (gas-liquid exchange is not performed in phenomenon) with the introduced liquid, the liquid supply can be performed by utilizing the negative pressure. Therefore, the arrangement position is not limited different from the conventional bag-shaped ink containing member, and the container can be disposed on a carriage. Moreover, the invention is also superior in that since the ink is directly held in the containing portion, the ink containing efficiency is enhanced.

On the other hand, in order to prevent the ink from running out during printing operation in the ink jet recording apparatus, a residual ink amount detecting mechanism is requested to be mounted which detects the ink consumption condition or residual amount and which informs a user that the time to exchange the ink tank is coming.

Additionally, in the ink tank in which the above-described negative pressure generating member containing chamber is adjacent to the ink containing chamber, when the ink of the ink containing chamber having a predetermined fixed containing space is supplied to the negative pressure generating member containing chamber, gas-liquid exchange is performed to guide gas into the ink containing chamber.

Therefore, when the ink of the ink containing chamber is supplied to the negative pressure generating member containing chamber, the amount of outside air corresponding to the ink amount is accordingly introduced, and the outside air and the ink are present in the ink containing chamber. When the outside air swells by the change of environment in which a printer is used (e.g., a temperature difference in one day), the ink in the ink containing chamber is guided toward the negative pressure generating member containing chamber in some cases. Therefore, in conventional cases, by considering the ink movement amount to the swelling proportion with various operation environments, the maximum buffer space is secured for the negative pressure generating member for practical use.

Moreover, in the conventional gas-liquid replacing operation, the introducing of the ink to the negative pressure generating member containing chamber from the ink containing chamber is performed with the introduction of the outside air via the connecting portion. Therefore, when a large amount of ink is supplied to the outside (liquid discharge head, and the like) from the negative pressure generating member containing chamber in a short time, the ink supply to the negative pressure generating member containing chamber from the ink containing chamber by the gas-liquid replacing operation possibly becomes insufficient to rapid ink consumption in the negative pressure generating member containing chamber. Therefore, also to avoid the ink supply shortage, the condition of the ink in the ink containing chamber needs to be known.

SUMMARY OF THE INVENTION

To solve the above-described problems, some of the present inventors have analyzed in detail the situation of the ink containing chamber containing air in the type of the ink tank in which the negative pressure generating member containing chamber is disposed adjacent to the ink containing chamber. As a result, it has been found that the amount of the ink moving to the negative pressure generating member from the ink containing chamber is regulated because the supply of the ink in the ink containing chamber to the negative pressure generating member containing chamber is performed with the introduction of gas.

Furthermore, as a result of further analysis, a reverse conception different from the conventional conception has been obtained that the expansion of the air present in the ink containing chamber by the external environmental change cannot be stopped but the expansion of the air in the ink containing chamber is permitted in the ink containing chamber.

The present invention has been developed as a result of the present inventors further intensive studies based on the above-described finding, and an object is to provide a liquid supply system in the type of ink tank constituted of a negative pressure generating member containing chamber disposed adjacent to an ink containing chamber, in which the residual amount of liquid in a liquid containing portion able to generate a negative pressure by deformation can be known, and particularly in which a user can know the time to exchange the liquid containing chamber when the liquid containing chamber can be exchanged.

Another object of the present invention is to realize a more stable liquid supply operation by detecting a liquid condition in a liquid containing portion particularly in a liquid supply system in which the liquid containing portion is of a exchangeable type.

To achieve the above-described objects, according to the present invention, there is provided a liquid supply system which comprises a negative pressure generating member containing chamber provided with a liquid supply portion for supply liquid to the outside and an atmosphere connecting portion for connecting with atmosphere for containing a negative pressure generating member holding the liquid inside; a liquid containing chamber connected to the negative pressure generating member containing chamber, forming a substantially sealed space except the connection, and having a liquid containing portion which can generate a negative pressure by deformation; and liquid residual amount detecting means for detecting a liquid level position of the liquid in the liquid containing portion to detect the liquid residual amount in the liquid containing portion.

According to the above-described liquid supply system, the liquid containing portion is deformed so as to keep a balance of negative pressure with the negative pressure generating member containing chamber, lessens the influence of the environmental change, smoothly supplies the liquid to the negative pressure generating member containing chamber, and detects the liquid level position of the liquid in the liquid containing portion, so that the ink residual amount can steadily be detected. Particularly, when the outside air is introduced into the liquid containing portion with the introducing of the liquid out of the liquid containing portion during the gas-liquid exchange, the deformation of the liquid containing portion is determined by the negative pressure characteristic of the liquid containing portion, and the deformation amount of the liquid containing portion does not largely change. Therefore, as compared with when the liquid residual amount is detected from the deformation degree of the liquid containing portion, the stability of the residual amount detection is further enhanced.

As the liquid residual amount detecting means, optical detecting means utilizing a light absorption or scattering change when light is transmitted through the liquid, electrostatic capacity detecting means utilizing an electrostatic capacity change of a liquid container containing the liquid, and the like can be used.

According to the present invention, there is provided a liquid residual amount detecting method for detecting a liquid residual amount in a liquid containing chamber of a liquid supply system comprising a negative pressure generating member containing chamber provided with a liquid supply portion for supplying liquid to the outside and an atmosphere connecting portion for connecting with atmosphere for containing a negative pressure generating member holding inside the liquid, and the liquid containing chamber connected to the negative pressure generating member containing chamber and having a liquid containing portion forming a substantially sealed space except the connection and able to generate a negative pressure by deformation. The method comprises: a first liquid supply step of deforming the liquid containing portion to generate the negative pressure and reducing the volume of the liquid containing portion, and moving the liquid in the liquid containing portion to the negative pressure generating member to supply the liquid to the outside without introducing outside air into the liquid containing portion from the atmosphere connecting portion via the negative pressure generating member containing chamber; a second liquid supply step subsequent to the first liquid supply step of introducing the outside air to the liquid containing portion and causing gas-liquid exchange to move the liquid in the liquid containing chamber to the negative pressure generating member containing chamber so that the liquid is supplied to the outside; and a liquid level position detecting step of detecting a liquid level position of the liquid in the liquid containing portion during the second liquid supply step to detect the liquid residual amount in the liquid containing portion.

According to the above-described liquid residual amount detecting method, since the liquid level position of the liquid in the liquid containing portion is detected during the second liquid supply step of performing the gas-liquid exchange between the liquid containing portion and the negative pressure generating member containing chamber to supply the liquid to the outside, the residual amount of the liquid in the liquid containing portion can steadily be detected as described above.

According to the present invention, there is provided a liquid residual amount detecting method for detecting a liquid residual amount in a liquid containing chamber of a liquid supply system comprising a negative pressure generating member containing chamber provided with a liquid supply portion for supplying liquid to the outside and an atmosphere connecting portion for connecting with atmosphere for containing a negative pressure generating member holding inside the liquid, and the liquid containing chamber detachably connected to the negative pressure generating member containing chamber and having a liquid containing portion forming a substantially sealed space except the connection and able to generate a negative pressure by deformation. The method comprises: a liquid level position detecting step of detecting a liquid level position of the liquid in the liquid containing portion at a predetermined time interval in a period when no liquid is supplied to the outside from the negative pressure generating member containing chamber; and a suction step of forcibly sucking a part of the liquid held by the negative pressure generating member from the liquid supply portion after the liquid containing portion is exchanged when a difference between the liquid level position detected in the liquid level position detecting step and the liquid level position detected in the previous liquid level position detecting step is lower than a predetermined value.

In the liquid supply system provided with the liquid containing chamber having the liquid containing portion which can generate the negative pressure by the deformation, also when no liquid is supplied to the outside from the negative pressure generating member containing chamber, the liquid is moved between the negative pressure generating member containing chamber and the liquid containing chamber by the environmental change, and the like. For example, when the liquid is guided to the negative pressure generating member containing chamber out of the liquid containing portion, and it is judged that the residual amount of the liquid in the liquid containing portion is reduced, the liquid containing chamber is exchanged as it is. Then, when the exchanged liquid containing chamber and the negative pressure generating member containing chamber are balanced in inner pressure, the liquid is excessively guided out of the new liquid containing chamber, and the liquid possibly leaks from the liquid containing portion of the negative pressure generating member containing chamber. In this case, like in the above-described liquid residual amount detecting method, also when no liquid is supplied to the outside from the negative pressure generating member containing chamber, the liquid level position of the liquid in the liquid containing portion is detected. When it is judged that the result has a less residual amount by a certain value or more than the previous result, the leakage of the liquid from the liquid containing portion after the exchange of the liquid containing chamber is securely prevented by forcibly sucking a part of the liquid from the liquid supply portion after the exchange of the liquid containing chamber.

Additionally, in the specification, the negative pressure generating member container and the liquid container are used when the containers can be separated from each other, and the negative pressure generating member containing chamber and the liquid containing chamber are used not only when they can be separated but also when both are constantly integrally disposed.

Moreover, the region unfilled with the liquid in the vicinity of the atmosphere connecting port of the negative pressure generating member containing chamber is used as a term including not only a space (buffer portion) provided with no negative pressure generating member as described later but also a case in which the negative pressure generating member is present but no ink is supplied.

BRIEF DESCRIPTION OF THE DRAWINGS

FIG. 2A is a sectional view by the same section as that of FIG. 1, and FIG. 2B is a sectional view taken along line A—A of the ink tank.

FIG. 3A is a sectional view by the same section as that of FIG. 1, and FIG. 3B is a sectional view taken along the line A—A of the ink tank of FIG. 1.

FIG. 4A is a sectional view by the same section as that of FIG. 1, and FIG. 4B is a sectional view taken along the line A—A of the ink tank of FIG. 1.

FIG. 5A is a sectional view by the same section as that of FIG. 1, and FIG. 5B is a sectional view taken along the line A—A of the ink tank of FIG. 1.

FIG. 6A is a sectional view by the same section as that of FIG. 1, and FIG. 6B is a sectional view taken along the line A—A of the ink tank of FIG. 1.

FIG. 9A is a detailed explanatory view of a negative pressure curve shown in FIG. 7, and FIG. 9B is an explanatory view showing the change condition of the amount of ink introduced from the ink containing portion and the amount of air introduced to the ink containing portion with the elapse of time when the liquid is continuously introduced.

FIGS. 11A-1, 11A-2, 11B-1, 11B-2, 11C-1 and 11C-2 are operation explanatory views of the ink tank in the pattern shown in FIG. 10.

FIGS. 13A-1, 13A-2, 13B-1, 13B-2, 13C-1 and 13C-2 are operation explanatory views of the ink tank in the pattern shown in FIG. 12.

FIGS. 15A-1, 15A-2, 15B-1, 15B-2, 15C-1, 15C-2, 15D-1 and 15D-2 are explanatory views of a stable liquid holding mechanism when the environmental condition of the ink jet cartridge shown in FIG. 1 is changed.

FIG. 18A is a sectional view of the ink jet cartridge in a step of detecting a liquid level (L1), and FIG. 18B is a sectional view of the ink jet cartridge in a step of detecting a liquid level (L2).

FIG. 19A is a sectional view of the ink jet cartridge when the ink tank is removed, and FIG. 19B is a sectional view of the ink jet cartridge in a suction recovery operation step.

DETAILED DESCRIPTION OF THE PREFERRED EMBODIMENTS

Embodiments of the present invention will be described hereinafter with reference to the drawings.

Additionally, an ink will be described hereinafter as an example of a liquid for use in a liquid supply system of the present invention, but the applicable liquid is not limited to the ink, and needless to say, for example, a processing liquid for a recording medium in an ink jet recording field is included.

First Embodiment

Figure 1:
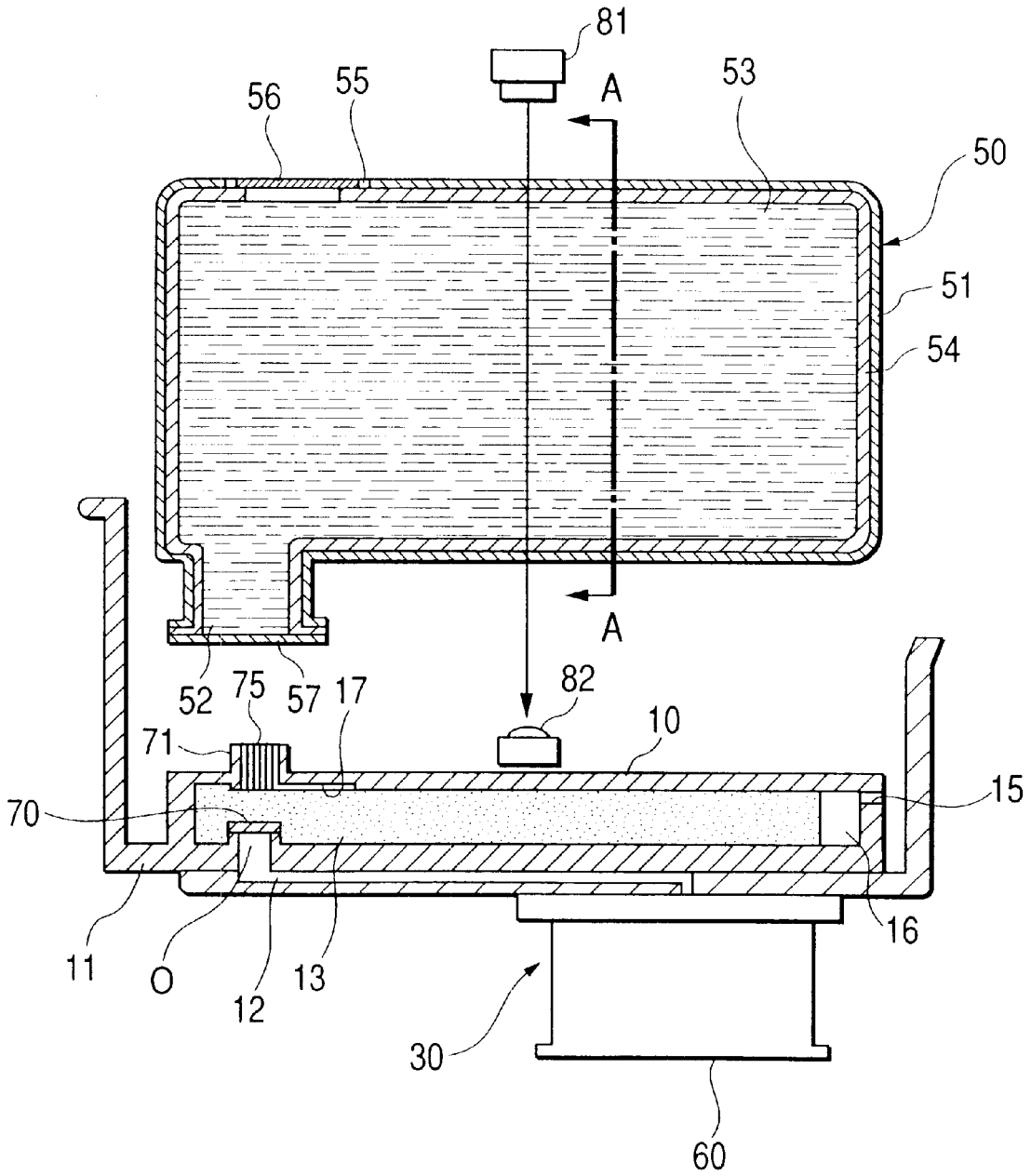
FIG. 1 is a sectional view showing an example in which a liquid supply system as a first embodiment of the present invention is applied to an ink jet cartridge.

FIG. 1 is a schematic explanatory view showing an example in which a liquid supply system as a first embodiment of the present invention is applied to an ink jet cartridge, and shows a sectional view before an ink tank is attached to a holder with a head.

As shown in FIG. 1, the ink jet cartridge is provided with an ink tank 50 as a liquid supply container for containing an ink therein, and a headed holder 30 integrally constituted of a tank holder 11 for holding the ink tank 50, a negative pressure generating member containing chamber 10 for temporarily holding the ink supplied from the ink tank 50 and a recording head 60 for discharging the ink supplied from the negative pressure generating member containing chamber 10 to perform recording.

The ink tank 50 is detachably attached to the headed holder 30 by an engagement structure (not shown), and provided with an ink containing portion 53 for containing the ink therein, and an ink supply portion 52 for introducing the liquid of the ink containing portion 53 to the negative pressure generating member containing chamber 10 described later. Moreover, the ink tank 50 is constituted of an outer wall 51 constituting a chamber (housing) and an inner wall 54 having the shape of an inner surface equal to or complementary to that of the inner surface of the outer wall 51.

The ink supply portion 52 is positioned on one end of the ink tank 50, and opened to the lower end surface of the ink tank 50. The ink supply portion 52 is sealed with a seal member 57 before the ink tank 50 is attached to the headed holder 30, and the ink containing portion 53 is in a sealed condition to the atmosphere.

The inner wall 54 has flexibility, and the ink containing portion 53 can be deformed when the ink contained inside is introduced to the outside. Moreover, the inner wall 54 has a welded portion 56 (pinch-off portion), and the inner wall 54 is engaged and supported on the outer wall 51 by the welded portion 56. Moreover, the outer wall 51 is provided with atmosphere connecting ports 55, so that the atmosphere can be introduced between the inner wall 54 and the outer wall 51.

On the other hand, the headed holder 30 is provided with the tank holder 11 for holding the ink tank 50, the negative pressure generating member containing chamber 10 disposed on the bottom of the tank holder 11, and the recording head 60 for discharging the ink (including the processing liquid and another liquid) to perform recording on the recording medium, and these components are integrally structured.

The negative pressure generating member containing chamber 10 contains a negative pressure generating member 13 constituted of a porous member of polyurethane foam, or a fibrous member of polyethylene, polypropylene or the like, and the ink is held by the capillary force of this negative pressure generating member 13. In the negative pressure generating member containing chamber 10, a connecting tube 71 connected to the ink supply portion 52 of the ink tank 50 and communicated with the ink containing portion 53 is disposed on a top wall, and an ink supply port O of an ink supply path 12 as a liquid supply portion for supplying the ink to the recording. head 60 is opened in a bottom wall. The ink supply port O is positioned below the connecting tube 71. Specifically, the connecting tube 71 and the ink supply port O are disposed on one end portion of the negative pressure generating member containing chamber 10. Additionally, the ink supply port O is provided with a filter 70 to prevent foreign matters from entering the recording head 60.

The negative pressure generating member containing chamber 10 is further provided with an atmosphere introducing groove 17 and an atmosphere connecting port 15. The atmosphere introducing groove 17 for promoting gas-liquid exchange as described later is formed in a horizontal direction toward the atmosphere connecting port 15 of the negative pressure generating member containing chamber 10 inside the top wall surface in the vicinity of the connecting tube 71, and connected into the connecting tube 71. The atmosphere connecting port 15 for connecting the negative pressure generating member 13 to the outside air is formed on the other end wall of the negative pressure generating member containing chamber 10. A buffer portion 16 in which no negative pressure generating member 13 is present is disposed in the vicinity of the atmosphere connecting port 15 of the negative pressure generating member containing chamber 10. In the present embodiment, the connecting tube 71 abuts on the negative pressure generating member 13, and its end portion is continuous with the atmosphere introducing groove 17 so that the liquid supply operation described later can smoothly be realized.

Furthermore, the liquid supply system of the present embodiment has ink residual amount detecting means for detecting the ink residual amount in the ink containing portion 53 of the ink tank 50. The ink residual amount detecting means is provided with a light emitting portion 81 and a light receiving portion 82 which are disposed opposite to each other via the ink tank 50 in a vertical direction. When the amount of light radiated from the light emitting portion 81 and transmitted through the ink tank 50 is detected by the light receiving portion 82, the residual amount of the ink in the ink containing portion 53 is detected. For this, the outer wall 51 and the inner wall 54 of the ink tank 50 are constituted of materials for passing the light radiated from the light emitting portion 81. Moreover, the light receiving portion 82 for detecting the light transmitted through the ink tank 50 is provided with a space in which the light receiving portion 82 is disposed between the ink tank 50 and the negative pressure generating member containing chamber 10. In the present embodiment, the light emitting portion 81 is positioned above the ink tank 50, and the light receiving portion 82 is positioned between the ink tank 50 and the negative pressure generating member containing chamber 10, but these positions may be reversed.

Additionally, in the following sectional views including FIG. 1, the region in which the negative pressure generating member 13 holds the ink is shown by a shaded part. Moreover, the ink contained in spaces such as the ink containing portion 53, the atmosphere introducing groove 17, and a gas-liquid exchange path is shown by a netted part.

An ink guiding member 75 is inserted into the connecting tube 71. As the ink guiding member 75 for effectively guiding the ink to the negative pressure generating member 13 from the top end of the connecting tube 71, for example, a felt-like member, a bunch of fibrous materials along the axial direction of the connecting tube 71, or the like is used. A groove connected to the atmosphere introducing groove 17 is also formed inside the connecting tube 71 along its axial direction, and the ink guiding member 75 is not disposed in this groove portion.

The ink tank 50 of the present embodiment is constituted of six planes forming a substantially rectangular parallelepiped shape, the cylindrical ink supply portion 52 is added as a curved surface, and the maximum area surface of this rectangular parallelepiped shape is indirectly shown on FIG. 1. Furthermore, for the thickness of the inner wall 54, the portion constituting the top portion (hereinafter referred to as the corner portion, including a case in which the top portion forms a micro curved surface shape) is thinner than the central region of each surface of the rectangular parallelepiped shape, and the thickness gradually decreases toward each corner portion from the central region of each surface to form a protruded shape inside the ink containing portion. In other words this direction is the same as the deformation direction of the surface, and an effect of promoting the deformation described later is provided.

Moreover, since the corner portion of the inner wall 54 is constituted of three faces, the strength of the entire corner portion of the inner wall 54 is relatively stronger than the strength of the central region as a result. Moreover, as seen from the extension of the face, its thickness is smaller as compared with the central region so that the face movement described later is permitted. The portion constituting the corner portion of the inner wall 54 preferably has a substantially equal thickness.

Additionally, since FIG. 1 is a schematic view, the outer wall 51 and the inner wall 54 of the ink tank 50 are shown as if they contact each other, but they may actually be in a detachable condition. Even when the inner wall 54 contacts the outer wall 51, they may be disposed via a micro space. However, the inner wall 54 extends along the inner surface shape of the outer wall 51, and at least the corner portion of the inner wall 54 is molded to contact the corner portion of the outer wall 51 (this condition is referred to as the initial condition) before the ink tank 50 is attached to the headed holder 30, that is, before the ink tank 50 is operated.

In this case, when a slightly smaller amount of ink than the amount of ink which can be contained in the ink containing portion 53 is contained in the ink containing portion 53 so that the ink supply portion 52 has a slightly negative pressure when the seal member 57 is opened, the ink can securely be prevented from leaking to the outside from the change of external force, temperature and atmospheric pressure when the seal member 57 is opened.

Moreover, from the standpoint of such environmental change, the amount of air contained in the ink containing portion 53 is preferably remarkably small. In order to reduce the amount of air contained in the ink containing portion 53, a liquid injecting method disclosed, for example, in Japanese Patent Application Laid-Open No. 10-175311 may be used.

On the other hand, the negative pressure generating member 13 of the negative pressure generating member containing chamber 10 usually partially holds the ink while the atmosphere introducing groove 17 is connected to the atmosphere via the negative pressure generating member 13, except before the liquid supply system is operated.

Here, since the amount of ink contained in the negative pressure generating member 13 depends on the amount of ink contained in the negative pressure generating member 13 during the exchange of the ink tank 50 described later, the amount may slightly vary. Moreover, the atmosphere introducing groove 17 and the connecting tube 71 do not necessarily have to be filled with the liquid, and may contain air as shown in FIG. 1.

The liquid supply operation of the ink of the present liquid supply system will next be described with reference to FIGS. 2A, 2B, 3A, 3B, 4A, 4B, 5A, 5B, 6A, 6B and 7. FIGS. 2A, 2B, 3A, 3B, 4A, 4B, 5A, 5B, 6A and 6B are schematic explanatory views showing in order the change when the ink tank 50 of the liquid supply system shown in FIG. 1 is attached to the headed holder 30 and the ink is discharged from the recording head 60, FIGS. 2A, 3A, 4A, 5A and 6A are sectional views by the same section as that of FIG. 1, and FIGS. 2B, 3B, 4B, 5B and 6B are sectional views taken along line A—A of FIG. 1. Moreover, FIG. 7 is an explanatory view showing a relation between the amount of ink introduced from the ink supply port O (the opening of the ink supply path 12 to the negative pressure generating member containing chamber 10) and the negative pressure of the ink supply port shown in FIG. 1, the abscissa indicates the amount of ink introduced to the outside from the ink supply port O, and the ordinate indicates the negative pressure (static negative pressure) of the ink supply port portion. FIG. 7 shows the change condition of the negative pressure shown in FIGS. 2A, 2B, 3A, 3B, 4A, 4B, 5A, 5B, 6A and 6B by arrows.

In the ink tank of the present embodiment, the ink supply operation is largely divided to three operations before, while, and after the gas-liquid exchange operation is performed. Furthermore, the operations will be described hereinafter in detail with reference to the drawings.

(1) Before Gas-Liquid Exchange

Figure 2B:
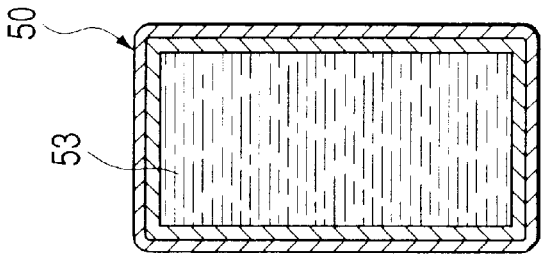
FIGS. 2A and 2B are explanatory views showing the condition of the ink jet cartridge shown in FIG. 1 immediately after the ink tank is attached to a holder with a head.
Figure 2A:
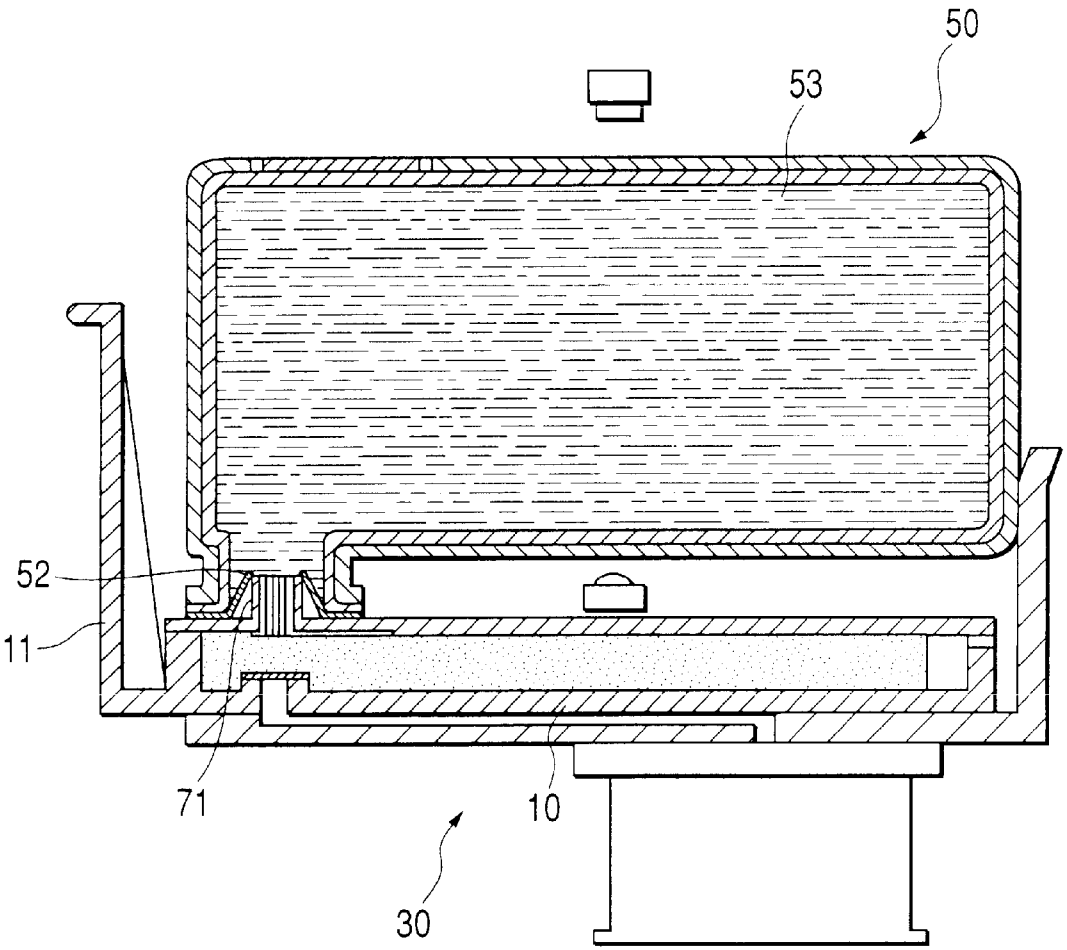

FIGS. 2A and 2B show the condition immediately after the ink tank 50 is attached to the headed holder 30 and before the ink in the ink tank 50 is introduced to the negative pressure generating member containing chamber 10.

The ink tank 50 is attached to the headed holder 30 by inserting the ink tank 50 into the opening of the tank holder 11 from above the headed holder 30. Thereby, the connecting tube 71 of the negative pressure generating member containing chamber 10 breaks the seal member to enter the ink supply portion 52, and the ink containing portion 53 or the ink tank 50 is connected to the negative pressure generating member containing chamber 10.

Figure 3B:
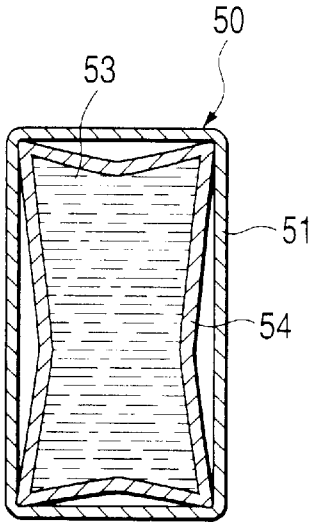
FIGS. 3A and 3B are explanatory views showing the operation start condition of the ink jet cartridge shown in FIG. 1.
Figure 3A:
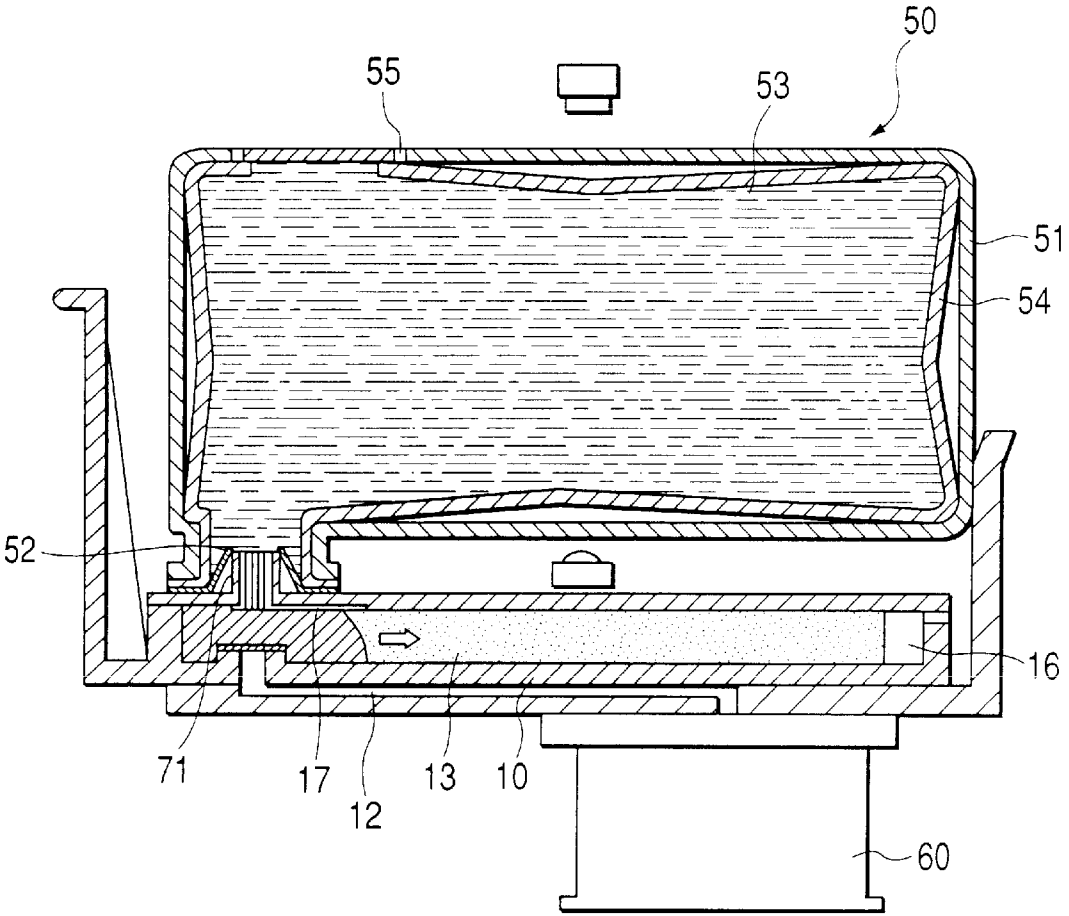

When the ink tank 50 is attached to the headed holder 30, the ink in the ink tank 50 is supplied to the negative pressure generating member containing chamber 10 through the connecting tube 71. In this case, in the negative pressure generating member containing chamber 10, as shown in FIGS. 3A and 3B, the ink moves as shown by the arrow of FIG. 3A until the pressures of the negative pressure generating member containing chamber 10 and the ink tank 50 become equal to each other, and an equilibrium condition is obtained when the pressure in the ink supply path 12 becomes negative (this condition will be referred to as the operation start condition).

The ink movement for obtaining the equilibrium condition will be described in detail.

When the connecting tube 71 of the negative pressure generating member containing chamber 10 is inserted to the ink supply portion 52 of the ink tank 50, the ink in the ink containing portion 53 flows to the connecting tube 71 to form an ink path with the negative pressure generating member 13 of the negative pressure generating member containing chamber 10. Moreover, when air is present in the connecting tube 71 in the condition shown in FIG. 2A, the air moves to the ink containing portion 53 (additionally, air is omitted from FIG. 3A).

When the ink path is formed, the ink movement to the negative pressure generating member 13 from the ink containing portion 53 is started by the capillary force of the negative pressure generating member 13. In this case, the inner wall 54 starts to be deformed from the central portion of the face with the maximum area in the direction in which the volume of the ink containing portion 53 decreases.

Here, since the outer wall 51 functions to suppress the displacement of the corner portion of the inner wall 54, in the ink containing portion 53 the action force of deformation by ink consumption and the action force to return to the shape of the initial condition (FIG. 1) are exerted, no rapid change is made, and the negative pressure is generated in accordance with the deformation degree. Additionally, since the space of the inner wall 54 and outer wall 51 is connected to the outside air via the atmosphere connecting port 55, air is introduced between the inner wall 54 and the outer wall 51 in accordance with the above-described deformation. Moreover, for the ink introduction to the atmosphere introducing groove 17, when the capillary force of the atmosphere introducing groove 17 is larger than the negative pressure generated by the ink containing portion 53 like in the present embodiment, the ink is charged.

When the ink movement is started and the ink is charged to the negative pressure generating member 13, the ink is also charged toward the atmosphere connecting port 15 from the tip end portion (the right end portion in the drawing) of the atmosphere introducing groove 17, and the atmosphere introducing groove 17 fails to be connected to the atmosphere. Then, since the ink tank 50 supplies and receives the ink and atmosphere only via the negative pressure generating member containing chamber 10, the ink movement is further performed so that the static negative pressure in the gas-liquid exchange path of the ink tank 50 and the static negative pressure in the connecting tube 71 of the negative pressure generating member containing chamber 10 are equalized.

Specifically, in this case, since the negative pressure on the side of the negative pressure generating member containing chamber 10 is larger than the negative pressure on the side of the ink tank 50, the ink is further moved to the negative pressure generating member containing chamber 10 from the ink tank 50 until both negative pressures become equal to each other, and the amount of ink held by the negative pressure generating member 13 of the negative pressure generating member containing chamber 10 accordingly increases. In this manner, the ink movement to the negative pressure generating member containing chamber 10 from the ink tank 50 is performed without introducing gas to the ink tank 50 via the negative pressure generating member 13. The static negative pressures of the ink tank 50 and negative pressure generating member containing chamber 10 in the equilibrium condition may be set to an appropriate value ($\alpha$ of FIG. 7) in accordance with the type of the recording head 60 in order to prevent the ink from leaking to the recording head 60 connected to the ink supply path 12.

The lower limit of the amount of ink movable from the ink tank 50 is the ink amount when the negative pressure generating member 13 is filled with the ink up to the tip end position (gas-liquid interface described later) of the atmosphere introducing groove 17 on the top surface of the negative pressure generating member 13, and the upper limit is the ink amount when the negative pressure generating member 13 is completely filled with the ink. Therefore, when the amount of ink moving to the negative pressure generating member 13 is determined from these upper and lower limit ink amounts by considering the dispersion of the amount of ink held by the negative pressure generating member 13 before connection, the material and thickness of the ink containing portion 53 can appropriately be selected in accordance with the negative pressure generating member 13 based on this ink amount and the value a of the negative pressure in the equilibrium condition.

Moreover, since there is a dispersion in the amount of ink held by the negative pressure generating member 13 before the connection, even in the equilibrium condition, the region unfilled with the ink of the negative pressure generating member 13 remains on the side of the atmosphere connecting port 15 in some cases. This region can be utilized together with the buffer portion 16 as the buffer region for the changes of temperature and pressure described later.

Conversely, when there is a possibility that the pressure of the ink supply port portion becomes positive in the equilibrium condition by the influence of the dispersion amount, suction recovery may be performed by suction recovery means disposed on a liquid discharge recording apparatus main body to allow a slight amount of ink to flow out.

Additionally, the ink path may be formed in the connecting tube 71 during the connection by utilizing impact during the connection, by pressing the ink containing portion 53 together with the outer wall 51 during the connection, or by pressurizing the ink containing portion 53 otherwise. Moreover, the ink containing portion 53 before the connection is placed in a slight negative pressure condition, and this negative pressure may be utilized to promote the movement of the gas in the connecting tube 71 to the ink containing portion 53.

Figure 4B:
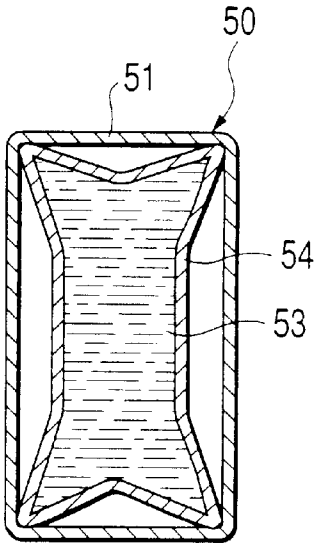
FIGS. 4A and 4B are explanatory views showing the condition of the ink jet cartridge shown in FIG. 1 during the introducing of the ink.
Figure 4A:
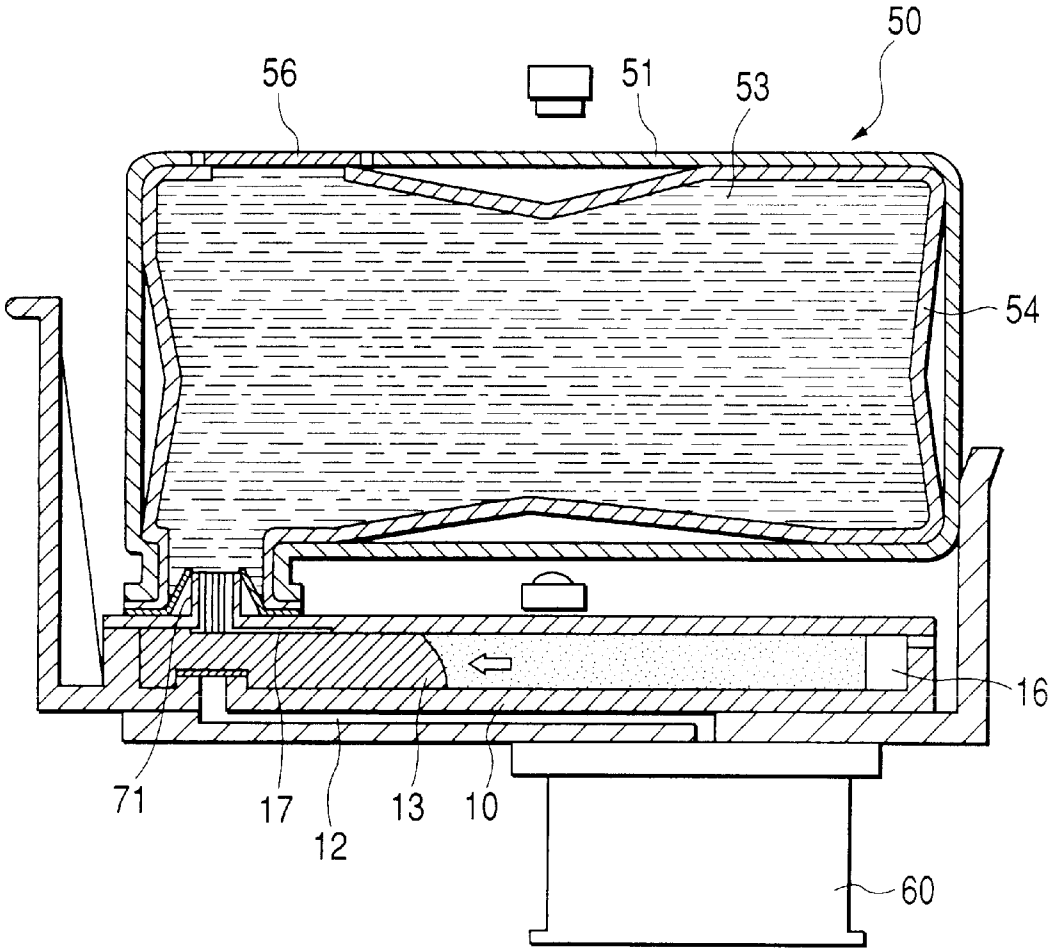

Subsequently, as shown in FIG. 4A, the ink is discharged via the recording head 60, thereby starting to consume the ink. In this case, while a balance is attained in the direction in which the values of the static negative pressures generated by both the ink containing portion 53 and the negative pressure generating member 13 increase, the ink held by both the ink containing portion 53 and the negative pressure generating member 13 is consumed (referred to as a first ink supply condition).

Specifically, when the ink is consumed via the recording head 60, the liquid level position of the negative pressure generating member 13 of the negative pressure generating member containing chamber 10 moves toward the left in FIG. 4A, that is, toward the ink supply port O, the ink containing portion 53 is further deformed, and the stable way of collapsing of the central portion of the ink containing portion 53 toward the inside is maintained.

Here, the welded portion 56 also serves as the portion for regulating the deformation of the inner wall 54, and for the face adjacent to the face having the maximum area, the portion having no welded portion 56 starts to be deformed relatively earlier than the region having the welded portion 56, and the inner wall 54 is detached from the outer wall 51. Additionally, in the present embodiment, since the opposite face with the maximum surface area is deformed substantially at the same time, more stable deformation is realized.

Additionally, for the change of the static negative pressure to the amount of ink introduced out of the ink supply port O in the condition shown in FIGS. 4A and 4B, the static negative pressure gradually increases in proportion to the amount of the introduced ink as shown in region A of FIG. 7. Even in this first ink supply condition, no air enters the ink containing portion 53 via the connecting tube 71.

(2) During Gas-Liquid Exchange Operation

Figure 5B:
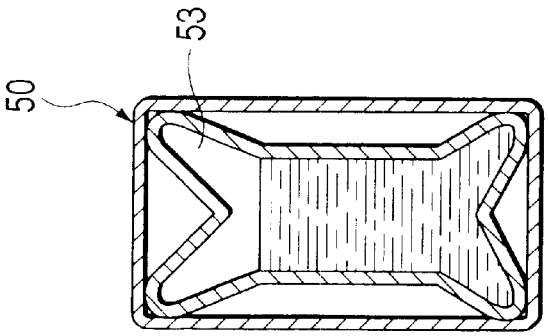
FIGS. 5A and 5B are explanatory views showing the gas-liquid replacing condition of the ink jet cartridge shown in FIG. 1.
Figure 5A:
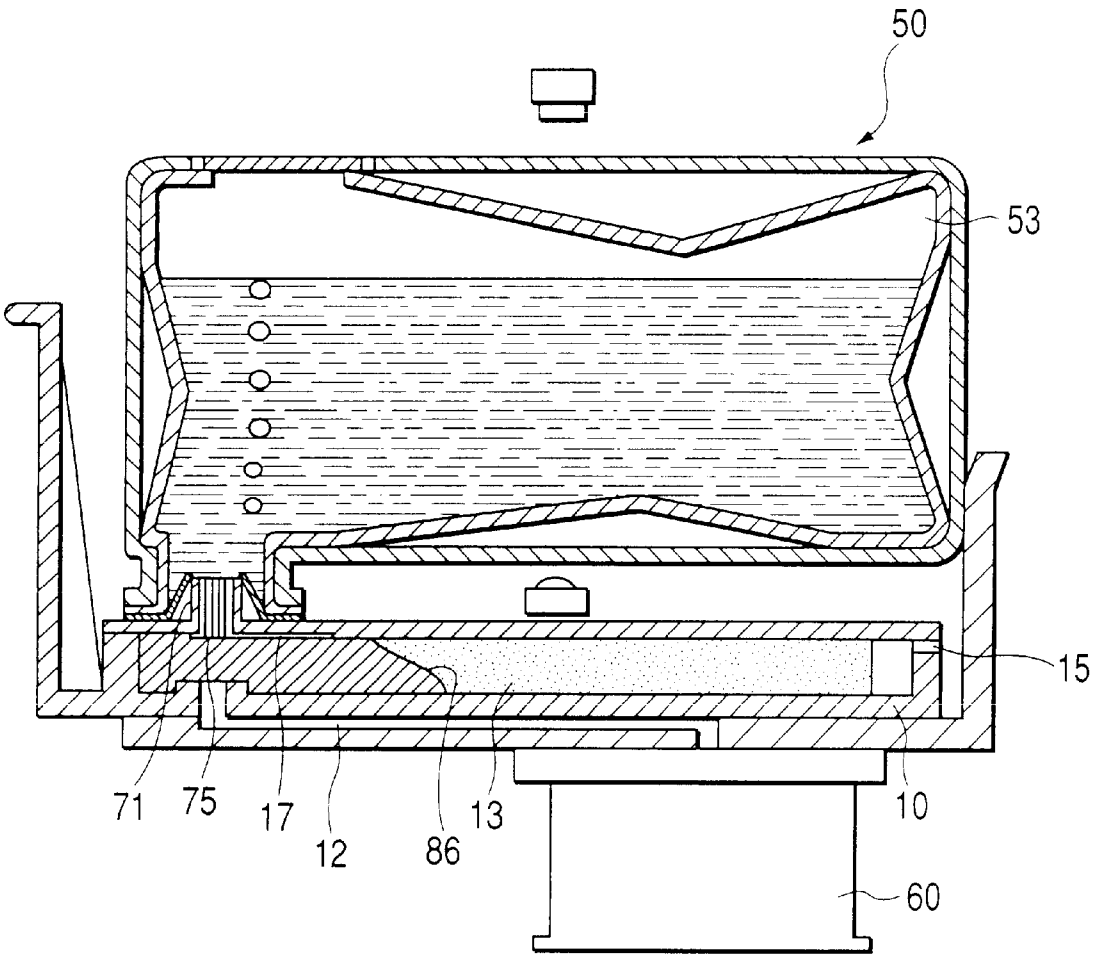

When the ink is further introduced out of the ink supply port O, as shown in FIGS. 5A and 5B, gas is introduced into the ink containing portion 53 (hereinafter referred to as a gas-liquid exchange condition, or a second ink supply condition).

In this case, the liquid level position of the negative pressure generating member 13 is substantially constant in the tip end portion of the atmosphere introducing groove 17 (gas-liquid interface 86), the air passed through the atmosphere introducing groove 17 and the connecting tube 71 enters the ink tank 50 via the atmosphere connecting port 15, then the ink from the ink tank 50 moves to the negative pressure generating member 13 of the negative pressure generating member containing chamber 10 through the ink guiding member 75 of the connecting tube 71.

Therefore, even when the ink is consumed by the recording head 60 as the liquid discharge recording means, the ink is charged to the negative pressure generating member 13 in accordance with the consumption amount, and the negative pressure generating member 13 holds a constant amount of ink. Moreover, since air is introduced to the ink containing portion 53, the shape during the gas-liquid exchange is substantially maintained, and the negative pressure of the ink tank 50 is also kept to be substantially constant, so that the ink supply to the recording head 60 is stabilized. For the change of the static negative pressure to the amount of ink introduced out of the ink supply port in the condition shown in FIGS. 5A and 5B, a substantially constant value is obtained for the amount of the introduced ink as shown in region B of FIG. 7.

The gas-liquid exchange operation of the ink tank of the present embodiment has been described above, but in the deformable ink containing portion 53 like in the constitution of the present embodiment, the operation during the gas-liquid exchange is not limited to the above-described operation.

When the ink containing portion is constituted of the conventional ink tank which cannot be deformed, the ink is immediately supplied to the negative pressure generating member with the introduction of the atmosphere to the ink containing portion.

On the other hand, when the ink containing portion 53 comprises the deformable ink tank 50 like in the present embodiment, in some cases the ink is supplied to the negative pressure generating member 13 even without the introduction of the atmosphere to the ink containing portion 53. Conversely, in some cases the ink is not immediately supplied toward the negative pressure generating member 13 even when the atmosphere is introduced to the ink containing portion 53 with the consumption of the ink. These are caused by the displacement of the ink containing portion 53 and the negative pressure balance with the negative pressure generating member containing chamber 10.

A concrete example of such operation will be described later. In the present constitution, the gas-liquid exchange operation different from that of the conventional ink tank constitution (different in timing from the conventional gas-liquid exchange operation) is performed in some cases. There is a time deviation between the introduction of the ink out of the ink containing portion 53 and the introduction of the gas to the ink containing portion 53 during the gas-liquid exchange. For example, even if there are external factors such as a rapid ink consumption, environmental change and vibration, the reliability of the stable ink supply can be enhanced by the buffer effect and timing deviation.

(3) After Gas-Liquid Exchange Operation

Figure 6B:
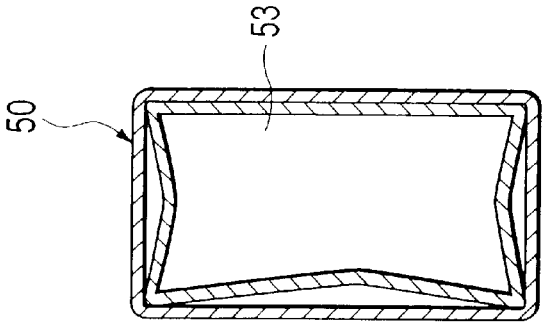
FIGS. 6A and 6B are explanatory views showing the condition of the ink jet cartridge shown in FIG. 1 before the exchange of the ink tank.
Figure 6A:
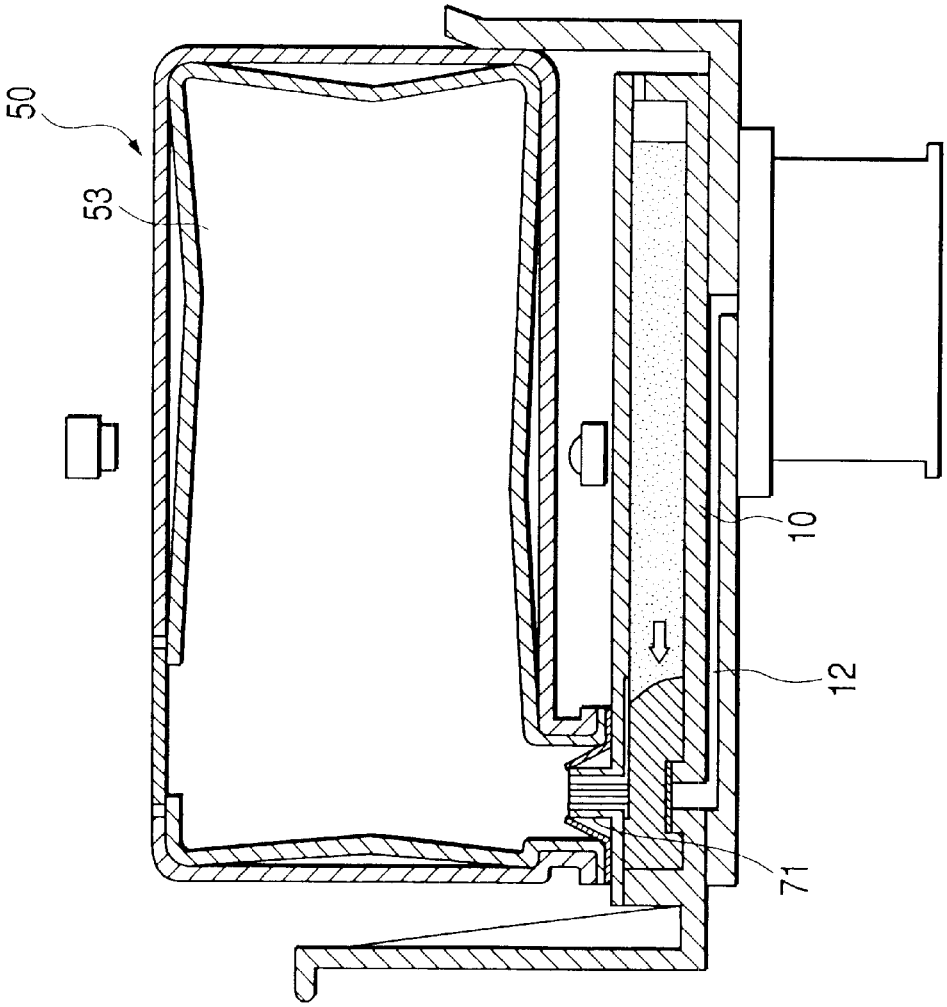
Figure 7:
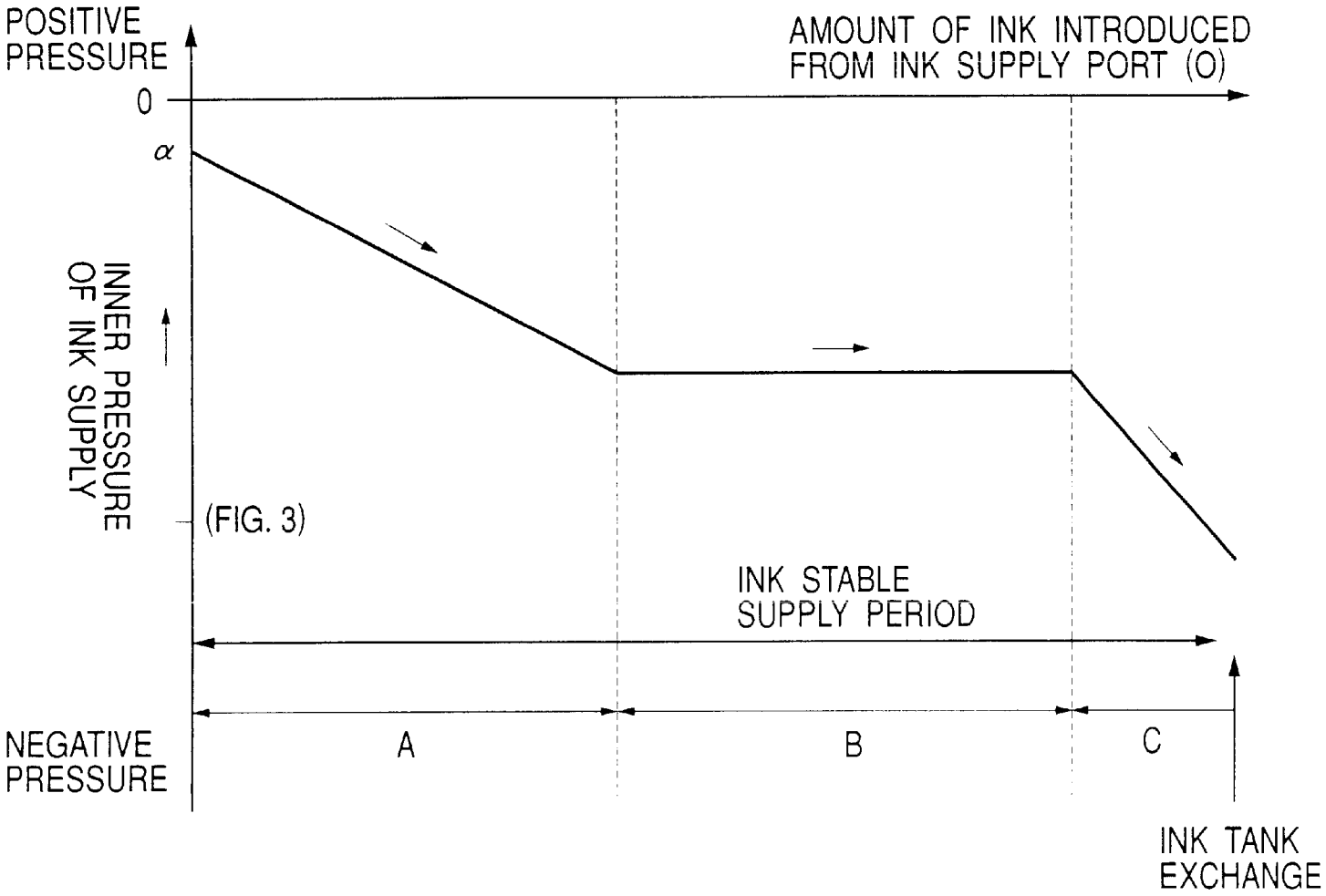
FIG. 7 is an explanatory view showing a relation between the amount of introduced ink and the negative pressure of an ink supply port of the ink jet cartridge shown in FIG. 1.

When the ink is further introduced out of the ink supply port O, as shown in FIGS. 6A and 6B, the ink of the ink containing portion 53 is completely consumed, and the ink remaining in the negative pressure generating member containing chamber 10 is consumed. For the change of the negative pressure to the amount of ink introduced out of the ink supply port O in the condition shown in FIGS. 6A and 6B, the negative pressure increases in proportion to the amount of the introduced ink as shown in region C of FIG. 7. In this condition, even when the ink tank 50 is removed, there is less possibility of ink leakage from the connecting tube 71. Therefore, the ink tank 50 may be removed and replaced with a new ink tank.

The liquid supply operation of the ink tank in the embodiment shown in FIG. 1 has been described above.

Specifically, when the ink tank 50 is connected to the negative pressure generating member containing chamber 10, the ink moves until the negative pressure generating member containing chamber 10 and the ink tank 50 are equal to each other in pressure and the operation start condition is attained. Thereafter, when the ink starts to be consumed by the recording head 60, first the values of the static negative pressures generated by both the ink containing portion 53 and the negative pressure generating member 13 are balanced in the increasing direction, and the ink held by both the ink containing portion 53 and the negative pressure generating member 13 is consumed. Subsequently, when gas is introduced to the ink containing portion 53, the negative pressure generating member 13 keeps the gas-liquid interface 86, the substantially constant negative pressure is held against the ink extraction in the gas-liquid exchange condition, and the ink remaining in the negative pressure generating member containing chamber 10 is then consumed.

As described above, according to the present invention, there is provided a step of using the ink of the ink containing portion 53 without introducing the outside air to the ink containing portion 53. Therefore, in this ink supply step (first ink supply condition) the internal volume of the ink tank 50 may be limited only by considering the air introduced to the ink containing portion 53 during the connection. Specifically, even when the limitation of the internal volume of the ink tank 50 is moderated, there is an advantage that the environmental change can be handled.

Moreover, according to the present invention, the ink in the ink tank 50 can substantially completely be consumed, additionally the connecting tube 71 may contain air during the exchange, and the ink tank 50 can be exchanged irrespective of the amount of ink held by the negative pressure generating member 13.

Particularly, since the ink tank 50 is positioned above the negative pressure generating member containing chamber 10, the direction of the ink supply to the ink supply port O from the ink tank 50 can be set to the direction following the gravity, and the stable supply condition can always be maintained. Additionally, by disposing the atmosphere introducing groove 17 connected to the connecting tube 71 in the horizontal direction close to the atmosphere connecting port 15, the above-described gas-liquid exchange can smoothly be performed.

Additionally, as shown in FIG. 7, the negative pressure increases in proportion to the ink introduced amount (region A), the constant value is then kept (region B), and thereafter the negative pressure increases in proportion to the ink introduced amount (region C). To achieve this relation, atmosphere is guided in before the opposite deformed faces of the ink containing portion abut on each other. Specifically, it is preferable to shift to the region B from the region A. This is because the proportion of the negative pressure change to the ink introduced amount in the ink containing chamber differs before and after the opposite maximum area faces contact each other.

The detecting of the ink residual amount in the ink tank 50 will next be described.

As described above, the ink residual amount in the ink tank 50 is detected by detecting the amount of light emitted from the light emitting portion 81 and transmitted through the ink tank 50 by the light receiving portion 82. Concretely, when the ink level position in the ink tank 50 lowers with the ink consumption in the ink tank 50, the light transmission distance in the ink is reduced, the light absorption/diffusion amount accordingly decreases, and light-receiving level in the light receiving portion 82 increases in an analog manner. By utilizing this property, the continuous change of the light-receiving level in the light receiving portion 82 by the change of the ink level position in the ink tank 50 can be detected as the change of the ink residual amount in the ink tank 50.

Figure 8:
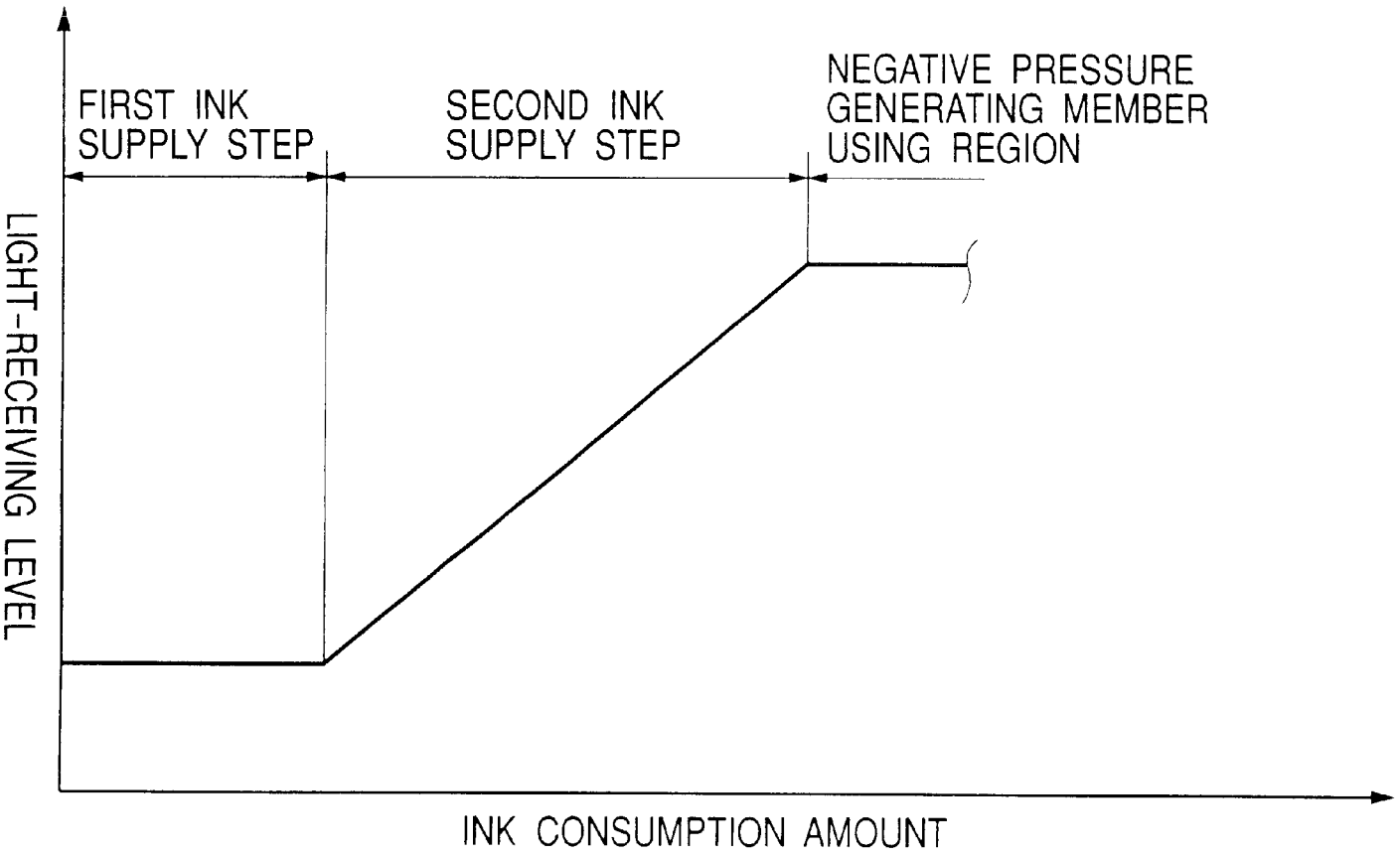
FIG. 8 is an explanatory view showing a relation between an ink consumption amount and a light-receiving level in a light receiving portion in the ink jet cartridge shown in FIG. 1.

FIG. 8 is a model diagram showing the characteristic of the light-receiving level change by the ink consumption. In the first ink supply step, as shown by the change of FIGS. 3A, 3B and 4A, 4B, the inner wall 54 is deformed while the ink is consumed, but the ink level position is unchanged, and the light-receiving level is therefore constant. Shifting to the second ink supply step, as shown in FIGS. 5A and 5B, the ink in the ink containing portion 53 is consumed during the gas-liquid exchange. Since the ink level position gradually lowers, the light-receiving level accordingly increases. Subsequently, when the ink in the ink containing portion 53 is all consumed, and the ink is consumed in the negative pressure generating member containing chamber 10, the light-receiving level is constant.

The position of the inflection point at which the first ink supply step shifts to the second ink supply step is determined by the negative pressure characteristic which is the ink supply characteristic of the ink tank 50. Since there are individual dispersions in local deformation sites in the wall surface of the inner wall 54 and the deformation speed distribution of each site, to directly detect the deformation of the inner wall 54 and to detect the ink residual amount from the deformation amount lack the stability of detection accuracy. On the other hand, the negative pressure characteristic of the ink containing portion 53 can be managed mainly by the thickness of the inner wall 54, and the like, which is easier than the management of the deformation behavior of the local site of each inner wall 54.

Therefore, in the ink tank 50 whose inner wall 54 is deformed until a certain negative pressure value is reached, by the constitution of detecting the change of the ink level position by the gas-liquid exchange, the above-described influence of the local site dispersion is offset, so that the ink residual amount detecting means difficult to receive the influence of dispersion of each inner wall 54 and superior in detection stability is realized. As s result, the residual amount of the ink contained in the ink tank 50 can approximately be grasped, and by displaying the ink residual amount in an analog or digital manner, the time to exchange the ink tank 50 can easily be notified to the user.

Since the ink residual amount is detected by the transmission distance of the light in the ink, in order to prevent influences from being easily exerted by the outer wall 51 and the inner wall 54 of the ink tank 50, these walls are preferably provided with high light transmission properties. However, when the light receiving portion 82 is superior in detection sensitivity, the light transmission properties may be low. The light transmission properties of the outer wall 51 and inner wall 54 may appropriately be determined by considering the height of the ink tank 50 with respect to the light transmission amount, that is, the transmission distance of the emitted light.

Figure 9A:
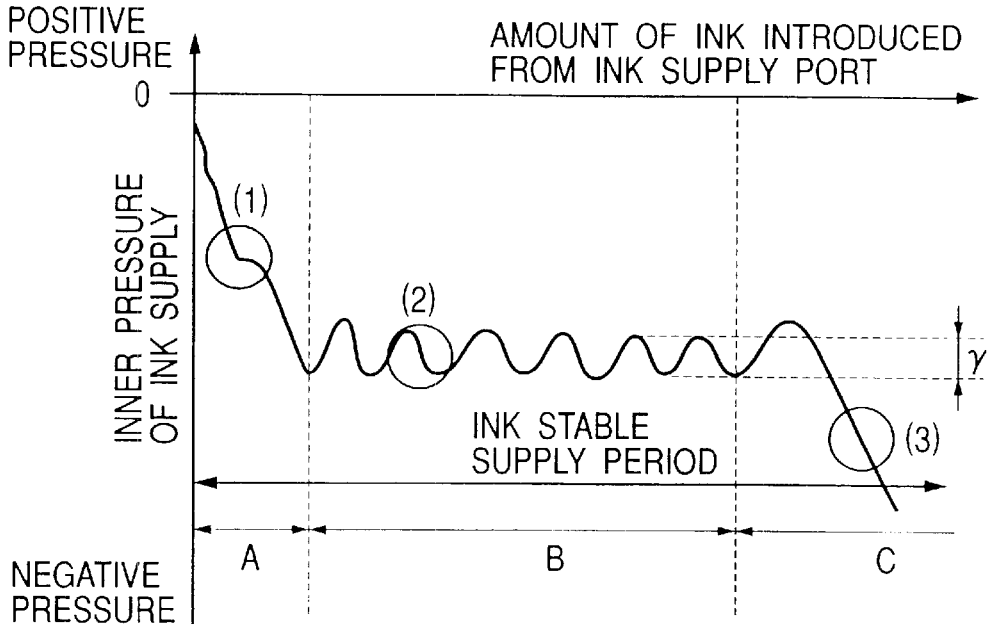
FIGS. 9A and 9B are graphs on the amount of ink introduced from the ink containing portion.

Additionally, when the change of the static negative pressure to the ink introduced amount was measured in detail, a curve was obtained as shown in FIG. 9A. Furthermore, by changing the material and thickness of the inner wall of the ink containing portion and the capillary force generated by the negative pressure generating member, the following findings on the detail of the ink supply operation were obtained.

Figure 9B:
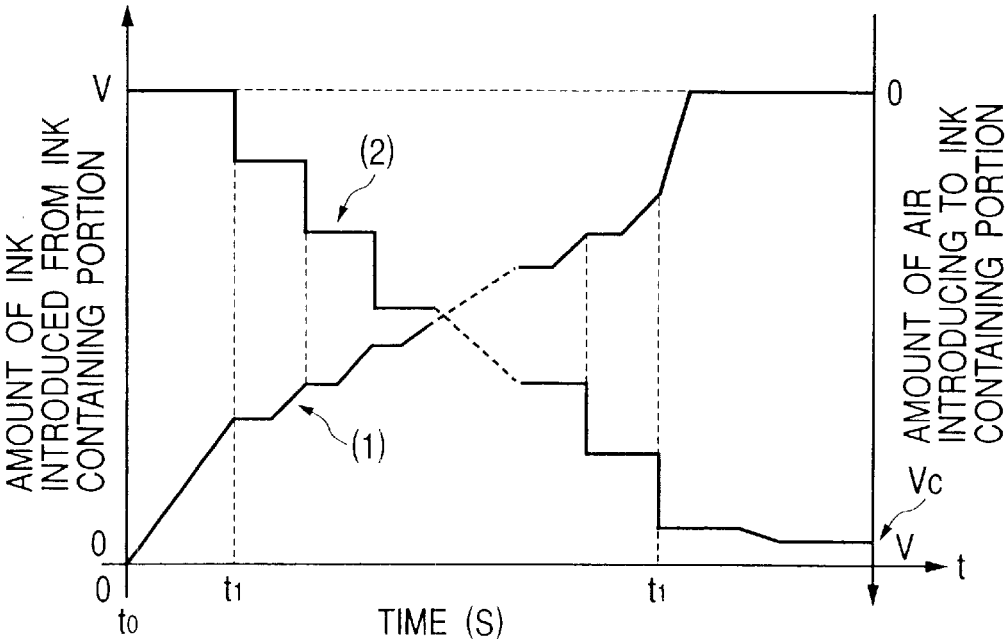
Figure 10:
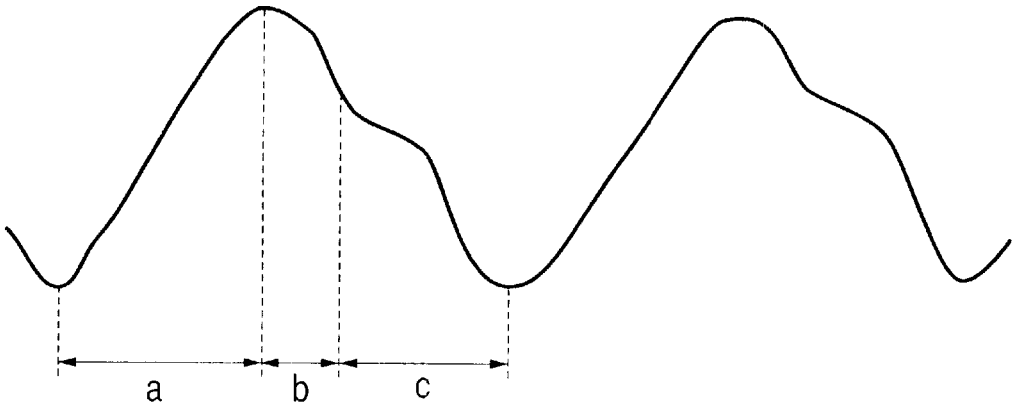
FIG. 10 is a detailed explanatory view of one example of region B shown in FIG. 9A.

Here, FIGS. 9A and 9B are detailed explanatory views showing one actual example of the negative pressure curve shown in FIG. 7, and (1), (2), (3) of FIGS. 9A and 9B correspond to the above-described operations (1), (2), (3). Moreover, FIG. 10 is a further detailed explanatory view showing one example of the region B of FIG. 9A, FIGS. 11A-1 to 11C-2 are explanatory views showing the operations of the ink tank in the pattern shown in FIG. 10 in order of FIGS. 11A-1 to 11C-1 and 11A-2 to 11C-2, FIG. 12 is a further detailed explanatory view showing another example of the region B of FIG. 9A, and FIGS. 13A-1 to 13C-2 are explanatory views showing the operations of the ink tank in the pattern shown in FIG. 12 in order of FIGS. 13A-1 to 13C-1 and 13A-2 to 13C-2. In FIGS. 11A-1 to 11C-2 and 13A-1 to 13C-2, affixed numeral 1 indicates a sectional view by the same section as that of FIG. 1, and affixed numeral 2 indicates a sectional view taken along A—A of the ink tank shown in FIG. 1. Additionally, to facilitate the understanding of the drawings for use in the description, the deformation of the ink containing portion, and the like are shown in a slightly exaggerated manner.

(1) Description of Region (1) of FIGS. 9A and 9B

The present region (before the gas-liquid exchange operation) is divided in the following three patterns to be described. Each pattern changes by the conditions such as the capillary force of the negative pressure generating member and the thickness and material of the ink containing portion, and by the balance of these conditions.

<First Pattern of Region (1) of FIGS. 9A and 9B>

The present pattern usually occurs when the ink containing portion is more dominant over the negative pressure control than the negative pressure generating member. Concretely, in many cases, the pattern occurs when the ink containing portion is relatively thick, or when the rigidity of the inner wall of the ink containing portion is relatively high.

In the ink introduction from the initial condition, first the ink is introduced out of the negative pressure generating member. This is because the resistance in introducing the ink out of the negative pressure generating member is smaller than the resistance in introducing the ink out of the ink containing portion. After the ink is first introduced out of the negative pressure generating member in this manner, the ink is introduced out of the negative pressure generating member and the ink containing portion in a balanced manner. When the ink is introduced out of the ink containing portion, the inner wall is deformed toward the inside.

<Second Pattern of Region (1) of FIGS. 9A and 9B>

In reverse to the above-described first pattern, the present pattern occurs when the negative pressure generating member is more dominant over the negative pressure control than the ink containing portion. In this case, the pattern frequently occurs when the inner wall of the ink containing portion is relatively thin, or when the rigidity of the inner wall is relatively small.

In the ink introduction from the initial condition, first the ink is introduced out of the ink containing portion. This is because the resistance in introducing the ink out of the ink containing portion is smaller than the resistance in introducing the ink out of the negative pressure generating member. Thereafter, the ink is introduced out of the negative pressure generating member and the ink containing portion in a balanced manner as described above.

<Third Pattern of Region (1) of FIGS. 9A and 9B>

The present pattern frequently occurs when the negative pressure generating member and the ink containing portion substantially have the equal dominant force over the negative pressure control.

In this case, in the introduction of the ink from the initial condition, the ink is introduced out of the negative pressure generating member and the ink containing portion in a balanced manner. While the balance is taken as it is, the condition shifts to the gas-liquid exchange condition described later.

(2) Description of Region (2) of FIGS. 9A and 9B

A gas-liquid exchange operation region will next be described. The region is divided in two patterns to be described. The region will be described in more detail with reference to the enlarged view of the negative pressure curve of the region (2) of FIGS. 9A and 9B.

<First Pattern of Region (2) of FIGS. 9A and 9B>

The present pattern usually occurs when the ink containing portion is more dominant over the negative pressure control than the negative pressure generating member. Concretely, in many cases, the pattern occurs when the ink containing portion is relatively thick, or when the rigidity of the inner wall of the ink containing portion is relatively high.

Figures 1, 11A:
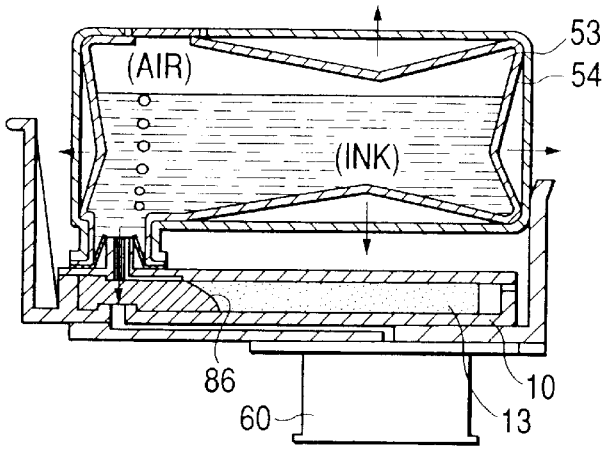
Figures 2, 11A:
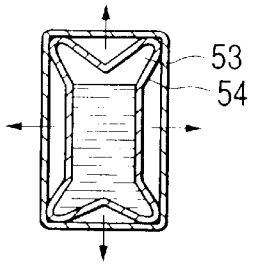

In the gas-liquid exchange operation region, the atmosphere is introduced to the ink containing portion from the negative pressure generating member containing chamber (region a of FIG. 10). This moderates the above-described balance of each negative pressure. By introducing the ink to this ink containing portion, as shown in FIGS. 11A-1 and 11A-2, the inner wall 54 of the ink containing portion 53 is slightly deformed outwardly. Moreover, when the atmosphere is introduced, the ink is supplied to the negative pressure generating member containing chamber 10 from the ink containing portion 53, and the gas-liquid interface 86 of the negative pressure generating member containing chamber 10 slightly moves to the right direction (FIGS. 11A-1 to 11B-2).

Figures 1, 11B:
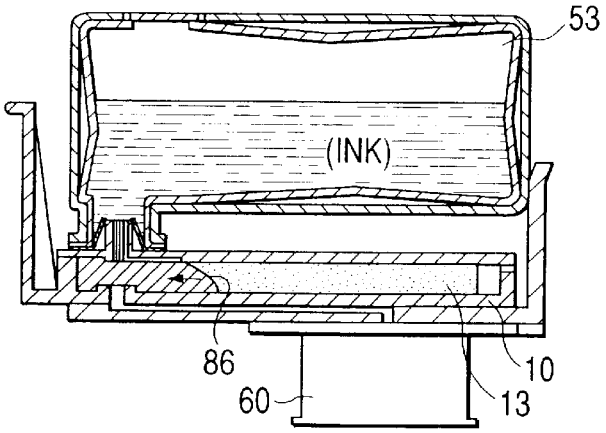
Figures 2, 11B:
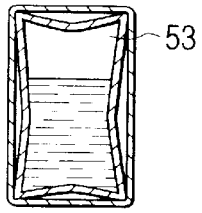

When the ink is further introduced out of the recording head 60, in the example, the ink is first introduced out of the negative pressure generating member 13. Thereby, as shown in FIGS. 11A-1, 11B-1 and 11C-1, the gas-liquid interface 86 of the negative pressure generating member containing chamber 10 changes in the left direction (region b of FIG. 10) (FIGS. 11B-1 and 11B-2).

Figures 1, 11C:
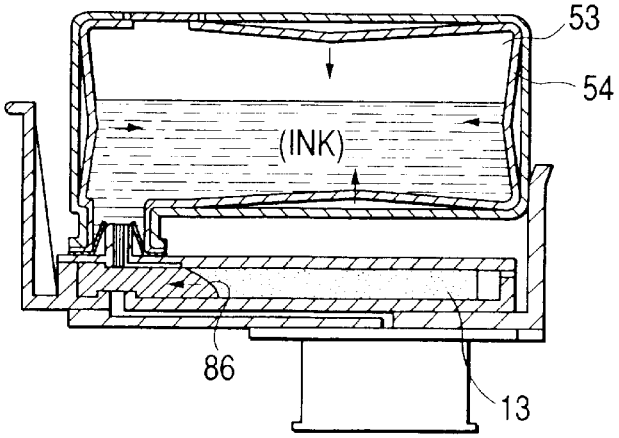
Figures 2, 11C:
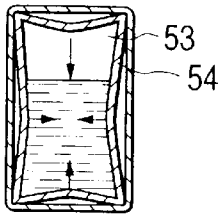

After this condition, the ink is introduced out of the negative pressure generating member 13 and the ink containing portion 53 in a balanced manner. Thereby, the gas-liquid interface 86 of the negative pressure generating member 13 further changes in the left direction, and the inner wall 54 of the ink containing portion 53 changes inwardly (region c of FIG. 10) (FIGS. 11C-1 and 11C-2).

After this condition continues, the atmosphere is introduced to the ink containing portion 53 via the atmosphere introducing groove 17, thereby shifting to the region a of FIG. 10.

<Second Pattern of Region (2) of FIGS. 9A and 9B>

In reverse to the above-described example, the present pattern occurs when the negative pressure generating member is more dominant over the negative pressure control than the ink containing portion. In this case, the pattern frequently occurs when the inner wall of the ink containing portion is relatively thin, or when the rigidity of the inner wall is small.

Figure 12:
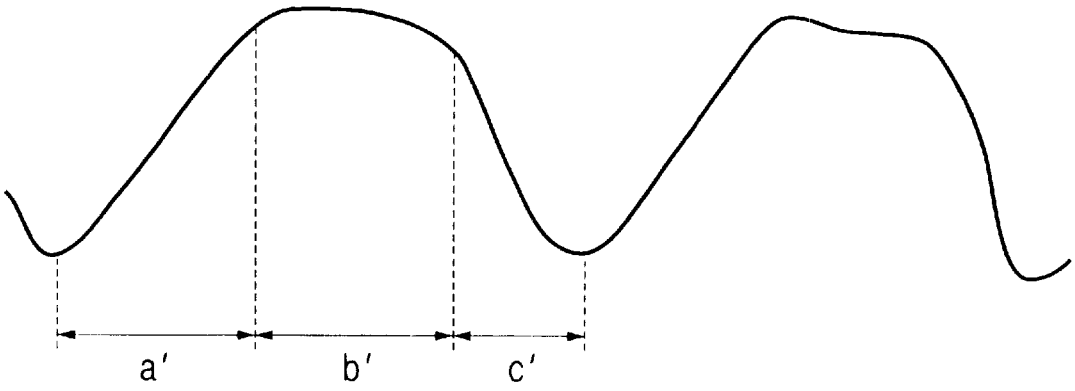
FIG. 12 is a detailed explanatory view of another example of the region B shown in FIG. 9A.
Figures 1, 13A:
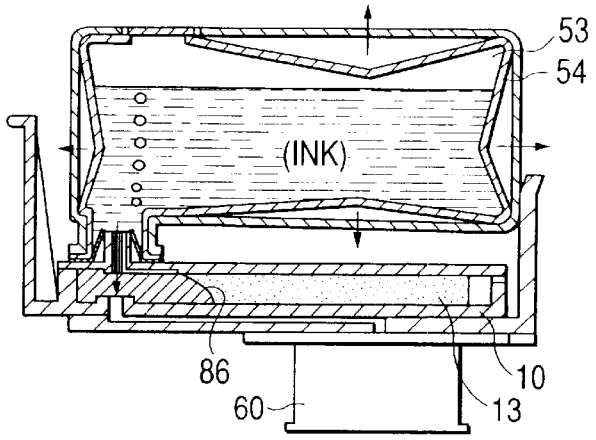
Figures 2, 13A:
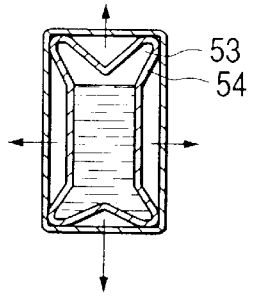
Figures 1, 13B:
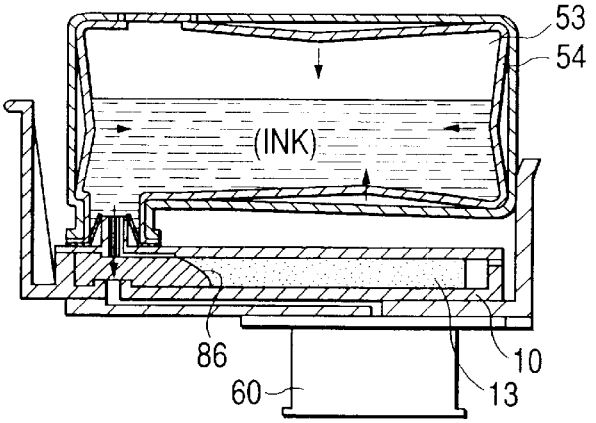
Figures 2, 13B:
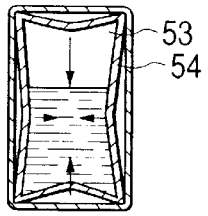

As described above, in the gas-liquid exchange operation region, the atmosphere is introduced to the ink containing portion from the negative pressure generating member containing chamber (region a' of FIG. 12). By introducing the ink to this ink containing portion, as shown in FIGS. 13A-1 and 13A-2, the inner wall 54 of the ink containing portion 53 is slightly deformed outwardly. Moreover, when the air is introduced, the ink is supplied to the negative pressure generating member containing chamber 10 from the ink containing portion 53, and the gas-liquid interface 86 of the negative pressure generating member containing chamber 10 slightly moves to the right direction (region a' to b' of FIG. 12).

When the ink is further introduced out of the recording head 60, in the present pattern, the ink is dominantly introduced out of the ink containing portion 53. In this case, the negative pressure hardly changes from the characteristics of the thickness and rigidity of the ink containing portion 53 and a smooth negative pressure rise is obtained. This ink introduction gradually deforms the inner wall 54 of the ink containing portion 53 inwardly (region b' of FIG. 12). Additionally, the ink is hardly introduced out of the negative pressure generating member 13 in this region, the gas-liquid interface 86 of the negative pressure generating member 13 is substantially unchanged.

Figures 1, 13C:
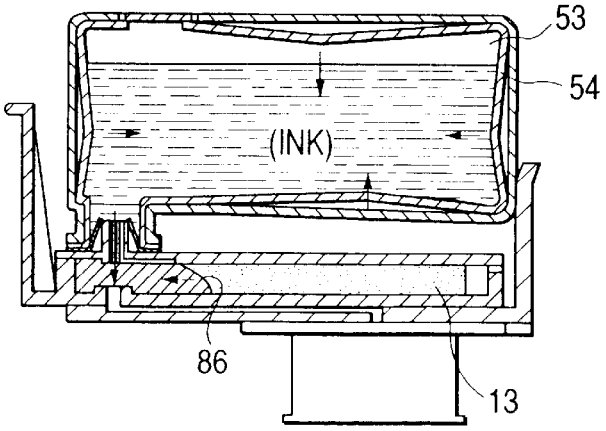
Figures 2, 13C:
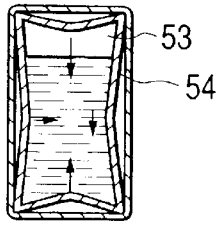

When the ink is further introduced out, the region b' shifts to region c' in which the ink is introduced from the negative pressure generating member 13 and the ink containing portion 53 in the balanced manner. In this region, the gas-liquid interface 86 of the negative pressure generating member 13 changes in the left direction as described above, and the inner wall 54 of the ink containing portion 53 changes inwardly (region c' of FIG. 12) (FIGS. 13C-1 and 13C-2).

After this condition continues, the atmosphere is introduced to the ink containing portion 53 via the atmosphere introducing groove 17, thereby again shifting to the region a' of FIG. 12.

(3) Description of Region (3) of FIG. 9A

Finally, the region (3) of FIG. 9A after the gas-liquid exchange region will be described.

This region is obtained after the ink introduction is advanced and the gas-liquid exchange is completed, that is, when the ink is almost introduced out of the ink containing portion, particularly when only the ink in the negative pressure generating member is introduced. The region is divided in the following two patterns to be described.

<First Pattern of Region (3) of FIG. 9A>

In the example, a case in which the pressure in the ink containing portion substantially reaches the atmospheric pressure after the gas-liquid exchange region will be described.

When the above-described gas-liquid exchange is completed, the ink in the ink containing portion is almost consumed. When the gas-liquid exchange is completed, a meniscus is usually extended in the atmosphere connecting path, the connecting path (connecting tube) of the negative pressure generating member containing chamber and the ink containing portion, or the negative pressure generating member. However, when the gas-liquid interface in the negative pressure generating member is positioned closer to the connecting tube than to the tip end portion of the atmosphere introducing groove, the above-described meniscus is broken by the factors such as carriage vibration. Thereby, the atmosphere is connected to the ink containing portion via the atmosphere introducing groove. Then, the atmospheric pressure is substantially obtained in the ink containing portion. Subsequently, the inner wall of the ink containing portion displaced inwardly tries to return to its original condition by its elastic force. However, usually the initial condition is not completely returned. Specifically, the inward deformation beyond the condition of the introduction of the ink from the ink containing portion results in a so-called buckling. Therefore, even when the atmospheric pressure is obtained in the ink containing portion, the original condition is not completely returned in many cases.

As described above, after the ink containing portion is placed in the atmospheric pressure condition, and the inner wall returns to its original condition, by introducing the ink out of the negative pressure generating member, the position of the gas-liquid interface in the negative pressure generating member approaches the ink supply port. Thereby, the negative pressure increases in the substantially proportional condition.

<Second Pattern of Region (3) of FIG. 9A>

In the present pattern, a case will next be described in which the negative pressure condition is maintained in the ink containing portion even when the gas-liquid interface of the negative pressure generating member is closer to the connecting tube than to the tip end portion of the atmosphere introducing groove.

As described above, the ink containing portion is disconnected from the atmosphere by the meniscuses in the atmosphere introducing groove, connecting tube, and negative pressure generating member. While this condition is maintained, the ink is consumed, and the gas-liquid interface in the negative pressure generating member continues to move toward the connecting tube in some cases. Therefore, while the inner wall of the ink containing portion maintains its inwardly deformed condition, the ink in the negative pressure generating member is consumed.

In this case, however, when the above-described meniscus is broken by the factors such as the carriage vibration and environmental change in the course of the ink consumption, the atmospheric pressure is substantially attained in the ink containing portion. In this case, the inner wall of the ink containing portion substantially returns to its original condition as described above.

As described above, as the characteristic of the phenomenon of the gas-liquid exchange operation in the present constitution, the pressure fluctuation (amplitude $\gamma$) during the gas-liquid exchange is relatively large as compared with the ink tank system in which the conventional gas-liquid exchange is performed.

This is because in the present constitution, as described in the region (1) of FIGS. 9A and 9B, by introducing the ink from the ink containing portion before performing the gas-liquid exchange, the inner wall is deformed toward the inside of the tank. Because of the elastic force of the inner wall, an outwardly exerted force always acts on the inner wall of the ink containing portion. Therefore, the amount of air entering the ink containing portion is set to a predetermined amount or more in order to reduce the pressure difference between the negative pressure generating member and the ink containing portion during the gas-liquid exchange. Therefore, the amount of the ink introduced to the negative pressure generating member containing chamber from the ink containing portion tends to increase. On the other hand, in the conventional system in which the ink containing portion is not deformed, when the predetermined amount of air enters, the ink is immediately introduced to the negative pressure generating member containing chamber.

Moreover, for example, to perform a solid mode printing, a large amount of ink is discharged from the recording head at once. Thereby, the ink is rapidly introduced from the ink tank, but in the present ink tank, the amount of ink introduced by the gas-liquid exchange is relatively large as compared with the conventional constitution. Therefore, there is no possibility that the ink runs out, and the reliability is enhanced.

Furthermore, according to the present constitution, since the ink is introduced out in the inwardly deformed condition of the ink containing portion, the buffer effect is high against the external factors such as the carriage vibration and environmental change.

Here, the above-described operations in a series of ink consumption processes will further be described from another standpoint with reference to FIG. 9B.

In FIG. 9B, the abscissa indicates time, and the ordinate indicates one example of the amount of ink introduced from the ink containing portion and the amount of air introduced to the ink containing portion. Moreover, the ink supply amount from the recording head is set to be constant with the elapse of time.

From the above-described standpoint, the amount of the ink introduced from the ink containing portion is shown by solid line (1), and the amount of the air introduced to the ink containing portion is shown by solid line (2).

The region before the gas-liquid exchange (region A) shown in FIG. 9A is shown from t=0 to t=t1. In the region, while the inks from the negative pressure generating member and the ink containing portion are balanced as described above, the ink is introduced from the recording head. Each introducing pattern is as described above.

The gas-liquid exchange region (region B) of FIG. 9A is shown from t=t1 to t=t2. In the region, the gas-liquid exchange is performed based on the above-described negative pressure balance. As shown by the solid line (1) of FIG. 9B, air is introduced into the ink containing portion (shown by steps of solid line (2)) to introduce the ink from the ink containing portion. In this case, with the air introduction, the amount of ink equal to the amount of the introduced air is not immediately introduced from the ink containing portion. For example, after a certain predetermined time elapses from the air introduction, the amount of ink equal to the amount of the finally introduced air is introduced out. As apparent from FIG. 9, a timing deviation is generated different from the conventional ink tank operation in which the ink containing portion is not deformed as described above. In the above-described gas-liquid exchange region, this operation is repeated. In a certain point, the amounts of air and ink in the ink containing portion are reversed.

After t=t2, there is provided the region after the gas-liquid exchange (region C) shown in FIG. 9A. In this region, the ink containing portion substantially has the atmospheric pressure as described above. (Dependent on the conditions, the atmospheric pressure condition is not obtained as described above.) Accordingly, the operation of returning to the initial condition is performed by the elastic force of the inner wall of the ink containing portion. However, the initial condition is not completely returned because of the so-called buckling as described above. Therefore, the final amount Vc of the air introduced to the ink containing portion is smaller than the initial amount V of the ink in the ink containing portion. Also in this region the ink from the ink containing portion is all used up.

In each condition in the course of the ink consumption, the operation of exchanging the ink tank will be described with reference to FIGS. 14A, 14B and 14C.

Figure 14A:
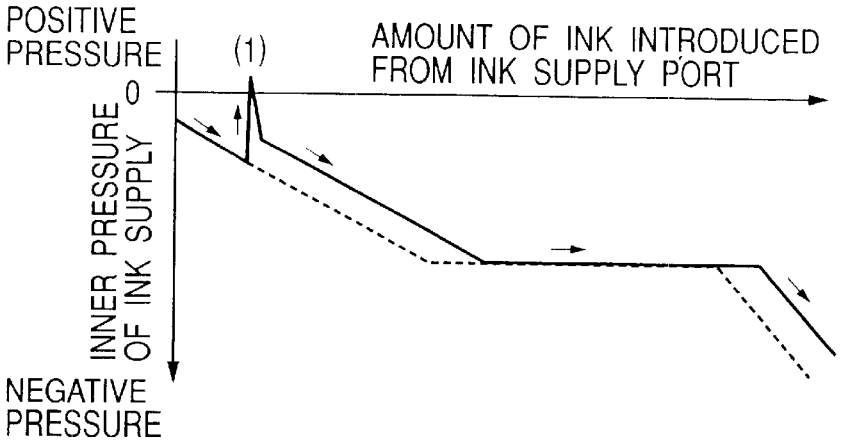
FIGS. 14A, 14B and 14C are explanatory views showing the operation during the exchange of the ink tank.

(a) Exchange of Ink Tank before Gas-Liquid Exchange (FIG. 14A)

In the condition before the gas-liquid exchange, as described above, while the negative pressure generating member and the ink containing portion are balanced to each other, the ink is consumed. In this condition, the negative pressure increases in the substantially proportional condition. Moreover, the gas-liquid interface in the negative pressure generating member is positioned closer to the connecting tube than to the. tip end of the atmosphere introducing groove.

At this time, when the ink tank is exchanged, the ink containing portion usually has a weak negative pressure or a positive pressure condition in the initial stage. Therefore, when the ink tank is newly attached, the ink of the ink containing portion is supplied to the negative pressure generating member, the amount of the ink in the negative pressure generating member containing chamber increases, and the gas-liquid interface is stabilized when the negative pressure generating member and the ink containing portion are balanced. In this case, the above-described buffer region is positioned farthest from the connecting tube of the negative pressure generating member. Therefore, even when the position of the gas-liquid interface moves far from the connecting tube, no ink leaks from the atmosphere connecting port.

When the ink tank is attached, the negative pressure lowers, and the pressure becomes positive in some cases, but an adequate negative pressure condition can quickly be formed by performing initial recovery during the tank attachment. Thereafter, the ink is consumed by the above-described consumption pattern.

Additionally, even when the negative pressure generating member of the negative pressure generating member containing chamber in the vicinity of the gas-liquid exchange path is unfilled with the ink, and when the ink path to the negative pressure generating member containing chamber from the ink containing portion is formed in the liquid supply system of the present invention, the ink in the ink containing portion can be moved to the negative pressure generating member by utilizing the capillary force of the negative pressure generating member containing chamber. Therefore, by attaching the ink tank irrespective of the condition of the ink held by the negative pressure generating member in the vicinity of the connection portion, the ink of the ink containing portion can securely be used.

In the present invention, it can easily be judged whether the tank has been exchanged in this condition, when the light-receiving level of the light receiving portion by the ink residual amount detecting means is the light-receiving level of "the first ink supply step". If necessary, the operation of performing initial recovery on the apparatus side after the tank exchange may be combined.

Figure 14B:
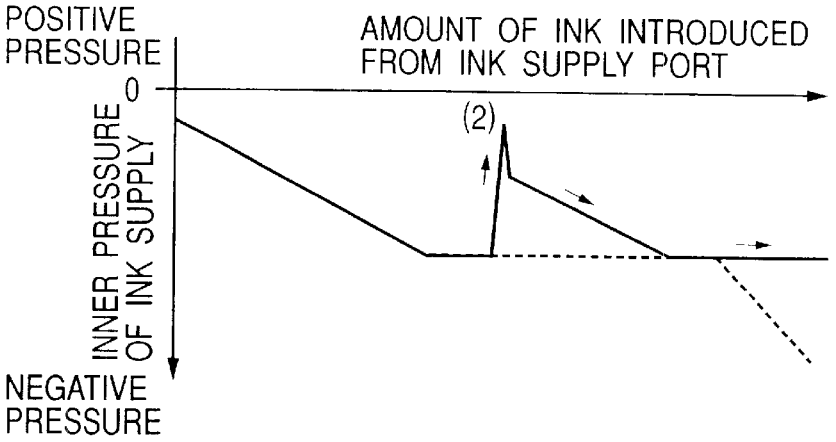

(b) Exchange of Ink Tank during Gas-Liquid Exchange (FIG. 14B)

In the gas-liquid exchange operation, as described above, the position of the gas-liquid interface in the negative pressure generating member is usually stabilized on the tip end portion of the atmosphere introducing groove, and the inner wall of the ink containing portion is deformed inwardly.

When the ink tank is removed in this condition, and a new ink tank having the initial condition is attached, the ink in the ink containing portion is supplied into the negative pressure generating member as described above, and the amount of the ink held by the negative pressure generating member increases. Specifically, the gas-liquid interface deviates to a position beyond the atmosphere introducing groove. Thereby, the inner wall of the ink containing portion is displaced inwardly, and a slight negative pressure condition is obtained in the ink containing portion.

After the position of the gas-liquid interface is stabilized and the ink is consumed, the ink is consumed according to the above-described consumption patterns (the first to third patterns of the area (1)). The gas-liquid exchange is performed at the predetermined negative pressure.

In the present invention, when the light-receiving level of the light receiving portion by the above-described ink residual amount detecting means is the light-receiving level of "the second ink supply step" shown in FIG. 8, it can be judged whether the tank exchange has been performed in this condition. A more preferable exchange operation will be described later in detail in a second embodiment.

Figure 14C:
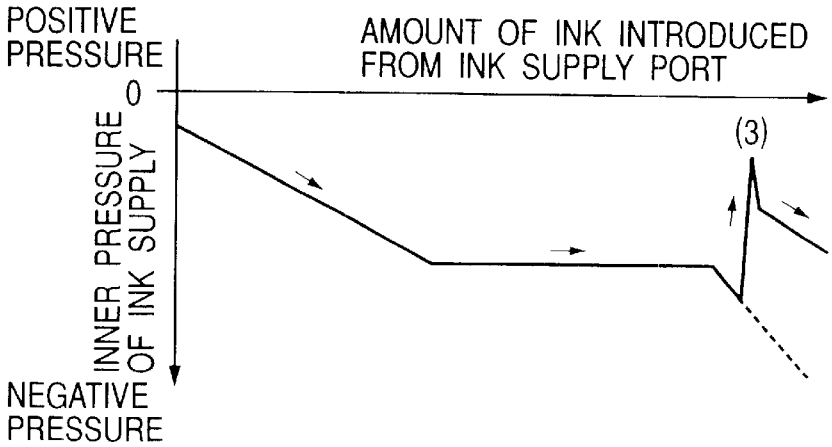

(c) Exchange of Ink Tank after Gas-Liquid Exchange (FIG. 14C)

In the condition after the gas-liquid exchange, the gas-liquid interface in the negative pressure generating member is closer to the connecting tube than to the tip end of the atmosphere introducing groove as described above, and the ink containing portion substantially has the atmospheric pressure and its inner wall substantially returns to the original condition, or the ink containing portion has therein the negative pressure condition and the inwardly deformed condition is maintained.

When the ink tank is exchanged in this condition, the ink in the ink containing portion is also supplied toward the negative pressure generating member, and the amount of the ink held by the negative pressure generating member increases. In this case, the gas-liquid interface usually reaches the position beyond the atmosphere introducing groove, but the gas-liquid interface may be balanced in the position closer to the connecting tube than to the atmosphere introducing groove. With the ink introduction the inner wall of the ink containing portion is displaced inwardly and placed substantially in the negative pressure condition.

When the gas-liquid interface is displaced beyond the atmosphere introducing groove, the region shifts to the gas-liquid exchange operation region after the above-described consumption process. Moreover, when the gas-liquid interface is balanced in the position closer to the connecting tube than to the atmosphere introducing groove, the gas-liquid exchange operation is immediately performed.

In the present invention, it can easily be judged whether the tank has been exchanged in this condition, when the light-receiving level of the light receiving portion by the above-described ink residual amount detecting means is the light-receiving level of "the negative pressure generating member using region" shown in FIG. 8.

As described above, even when the ink tank is exchanged in the consumption processes of (a) to (c), a stable negative pressure can be generated, so that the liquid supply operation can securely be performed. Particularly, in the present invention, by disposing the liquid residual amount detecting means, the condition in which the ink tank has been exchanged can easily be distinguished.

Furthermore, according to the constitution of the present invention, in the second ink supply condition, or in another case in which the ink containing portion contains air, the environmental change can be handled by a solving method different from the conventional method.

Here, the stable liquid holding mechanism of the ink tank shown in FIG. 1 when the environmental conditions are changed will next be described with reference to FIGS. 15A-1 to 15D-2 and 16.

FIGS. 15A-1 to 15D-2 are explanatory views showing the function of the negative pressure generating member as the buffer absorbing member and the buffer action of the ink containing portion, and shows the change of the ink containing portion from the condition of FIGS. 5A and 5B (gas-liquid exchange condition) until the air in the ink containing portion is expanded by the reduction of the atmospheric pressure, temperature rise, and the like in order of (a) to (d). Affixed numeral 1 indicates a sectional view by the same section as that of FIG. 1, and affixed numeral 2 indicates a sectional view taken along the line A—A shown in FIG. 1.

Figures 1, 15A:
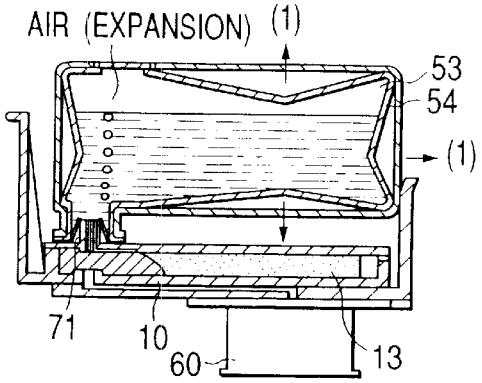
Figures 2, 15A:
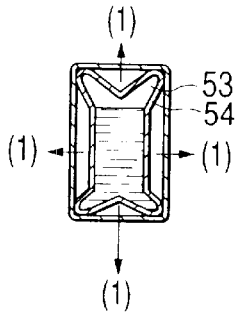
Figures 1, 15B:
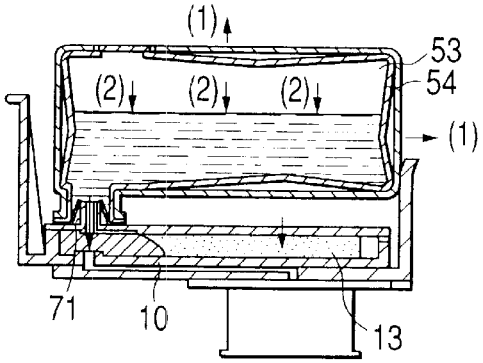
Figures 2, 15B:
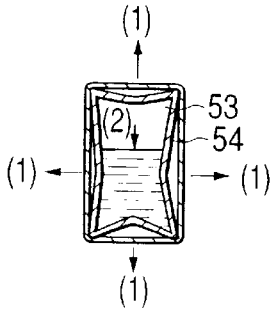

When the air in the ink containing portion 53 is expanded by the reduction of the atmospheric pressure (or the temperature rise), as shown in FIGS. 15B-1, 15B-2, the wall surface (1) and the liquid level (2) constituting the ink containing portion 53 are pressed, the internal volume of the ink containing portion 53 increases, and additionally a part of the ink flows out toward the negative pressure generating member containing chamber 10 from the ink containing portion 53 via the connecting tube 71. Here, since the internal volume of the ink containing portion 53 increases, the amount of the ink flowing to the negative pressure generating member 13 (the movement of the liquid level of the negative pressure generating member 13 shown by (3) of FIG. 15C-1) is remarkably reduced as compared with when the ink containing portion 53 cannot be deformed.

Here, when the atmospheric pressure change is steep, the amount of the ink flowing out via the connecting tube 71 moderates the negative pressure in the ink containing portion 53 and increases the internal volume of the ink containing portion 53. Therefore, the influences of the resistance of the wall surface generated by relaxing the inward deformation of the inner wall of the ink containing portion 53 and the resistance for moving the ink to be absorbed by the negative pressure generating member 13 are dominant in the initial stage.

Particularly, in the present constitution, since the flow resistance of the negative pressure generating member 13 is larger than the resistance of the inner wall 54 against recovery, first as shown in FIGS. 15A-1 and 15A-2 the internal volume of the ink containing portion 53 increases with the air expansion. Furthermore, when the volume increase by the air expansion is larger than the upper limit of the increase, as shown in FIGS. 15B-1 and 15B-2, the ink flows toward the negative pressure generating member containing chamber 10 from the ink containing portion 53 via the connecting tube 71. Specifically, since the wall surface of the ink containing portion 53 functions as the buffer against the environmental change, the ink movement in the negative pressure generating member 13 is moderated, and the negative pressure characteristic in the ink supply port portion is stabilized.

Figures 1, 15C:
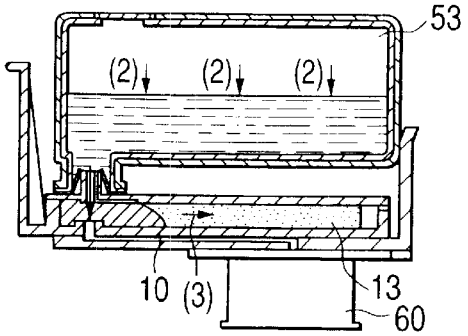
Figures 2, 15C:
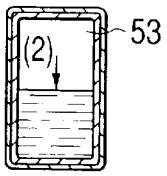

Additionally, in the present embodiment, the ink flowing out to the negative pressure generating member containing chamber 10 is held by the negative pressure generating member 13. In this case, as shown in FIGS. 15C-1 and 15C-2, the ink amount of the negative pressure generating member containing chamber 10 temporarily increases and the gas-liquid interface moves toward the right of FIG. 15C-1. Therefore, in the same manner as in the operation initial stage, the inner pressure temporarily shifts slightly to the positive side as compared with the stable stage of the ink inner pressure, but the influence onto the discharge characteristic to the liquid discharge recording means such as the recording head 60 is small, and there is no practical problem. Moreover, when the atmospheric pressure is recovered to the level before the pressure reduction (returns to 1 atmospheric pressure) (or the original temperature is returned), the ink which has leaked to the negative pressure generating member containing chamber 10 and held by the negative pressure generating member 13 returns back to the ink containing portion 53, and additionally the volume of the ink containing portion 53 returns to its original condition.

Figures 1, 15D:
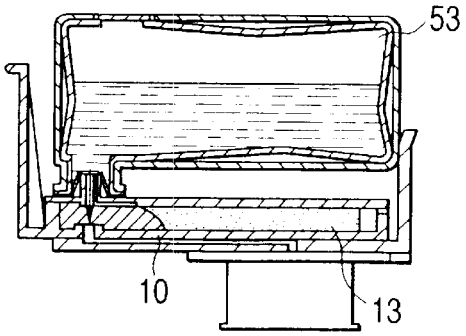
Figures 2, 15D:
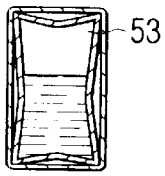

The principle operation will next be described with reference to FIG. 16 in which after the atmospheric pressure change and initial operation, the stationary condition shown in FIGS. 15D-1 and 15D-2 is attained under the changed atmospheric pressure.

This condition is characterized in that not only the amount of the ink introduced from the ink containing portion but also the interface of the ink held by the negative pressure generating member change so that the balance is kept against the fluctuation of the negative pressure by the volume change of the ink containing portion itself.

Here, with respect to the relation between the ink absorption amount of the negative pressure generating member and the ink tank in the present invention, from the standpoint of preventing the ink from leaking from the atmosphere connecting port or the like during the above-described pressure reduction or temperature change, the maximum ink absorption amount of the negative pressure generating member containing chamber is determined by considering the amount of the ink flowing out from the ink tank under worst conditions and the amount of the ink held by the negative pressure generating member containing chamber during the ink supply from the ink tank, and the negative pressure generating member containing chamber may be provided with at least the volume for containing the negative pressure generating member.

Figure 16:
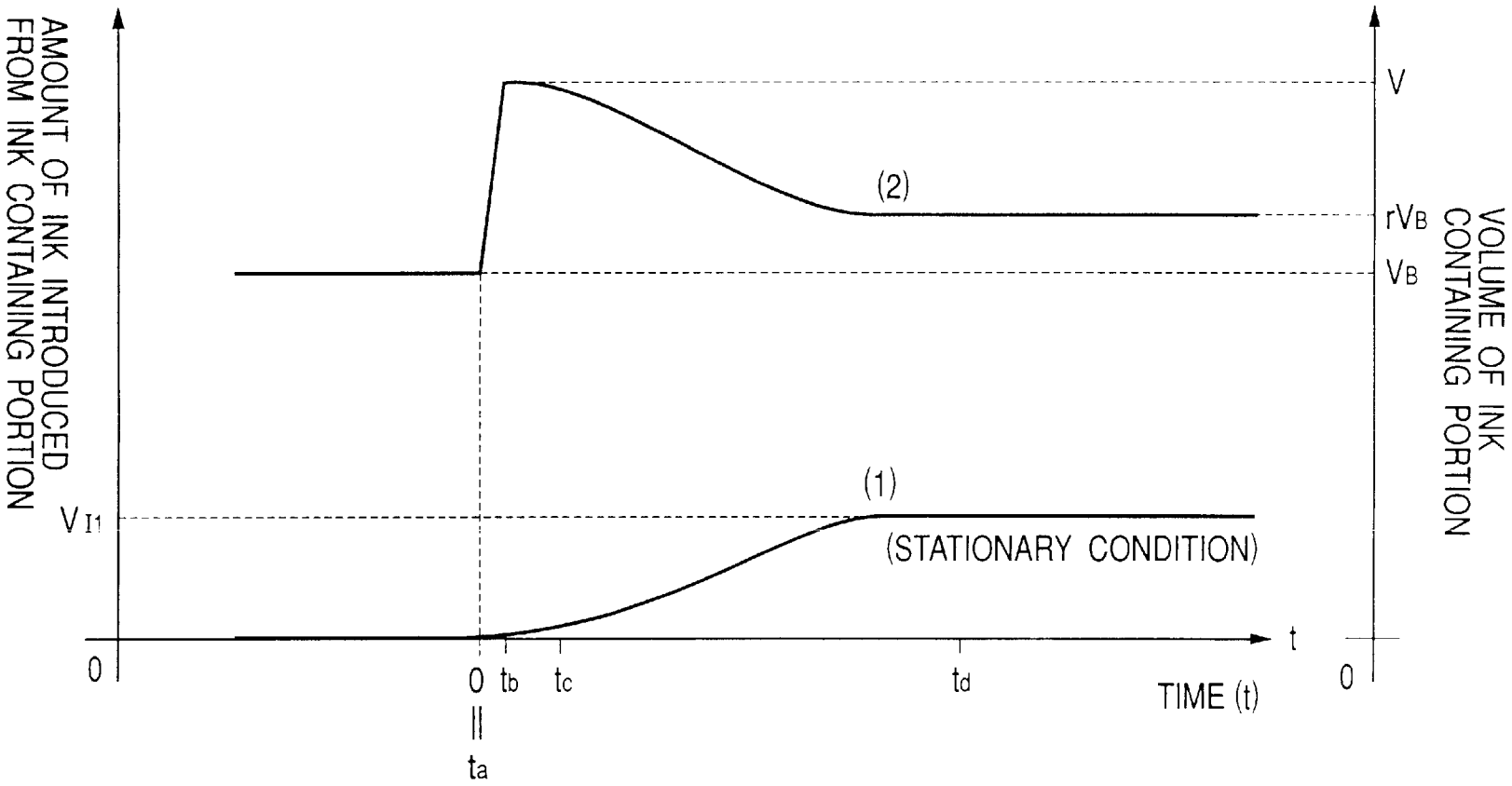
FIG. 16 is an explanatory view showing the change of the amount of ink introduced from the ink containing portion and the volume of the ink containing portion with the elapse of time when the pressure of the ink jet cartridge shown in FIG. 1 is reduced.

FIG. 16 schematically shows the amount of the ink introduced from the ink containing portion and the volume change of the ink containing portion with the elapse of time when the initial air volume is set to $V_{Al}$ and when the ink tank environment is changed from the atmospheric pressure to the pressure reduction environment of P atmospheric pressure ($0<P<1$). In FIG. 16, the abscissa indicates time (t), the ordinate indicates the amount of the ink introduced from the ink containing portion and the volume of the ink containing portion, the change of the amount of the ink introduced from the ink containing portion with the elapse of time is shown by solid line (1), and the change of the volume of the ink containing portion with the elapse of time is shown by solid line (2).

The conditions of the ink tank at t=ta, t=tb, t=tc, t=td in FIG. 16 correspond to FIGS. 15A-1 to 15D-2.

As shown in FIG. 16, the steep environmental change can be handled by the air expansion mainly in the ink containing portion before the stationary condition in which the negative pressure generating member containing chamber and the ink containing portion are balanced in negative pressure. Therefore, the ink introduction timing to the negative pressure generating member containing chamber from the ink containing portion can be delayed against the steep environmental change.

Therefore, there can be provided an ink supply system in which the tolerance for the expansion of the outside air introduced by the gas-liquid exchange is enhanced and ink supply can be performed under stable negative pressure conditions during the operation of the ink containing portion even under various operation environments.

According to the present invention, by appropriately selecting the materials of the negative pressure generating member and the ink containing portion for use, the volume proportion of the negative pressure generating member containing chamber and the ink containing chamber can arbitrarily determined. Even when the proportion is larger than 1:2, the cambers can practically be used.

Particularly, when the buffer effect of the ink tank is made much of, the deformation amount of the ink containing portion of the gas-liquid exchange condition to the operation start condition may be enlarged within a range in which elastic deformation is possible.

Additionally, in order to effectively exercise the buffer effect of the above-described ink containing portion, the deformation of the ink containing portion is preferably small while the amount of the air present in the ink containing portion is small. Specifically, after the connection, the amount of the air present in the ink containing portion before the gas-liquid exchange condition is preferably as small as possible.

Additionally, as described with reference to FIGS. 15A-1 to 15D-2 and 16, the wall surface of the ink containing portion 53 functions as the buffer against the environmental change. However, although the ink of the negative pressure generating member containing chamber 10 is not consumed, the ink moves between the ink containing portion 53 and the negative pressure generating member containing chamber 10, and the ink liquid level position in the ink containing portion 53 fluctuates until the stationary condition is attained. Moreover, when the ink supply system of the present embodiment is applied to a serial type ink jet recording apparatus, and the headed holder 30 is mounted on a reciprocating carriage, the ink liquid level position in the ink containing portion 53 fluctuates immediately after the completion of printing operation. In this case, the ink residual amount in the ink containing portion 53 detected by the ink residual amount detecting means is remarkably incorrect.

In order to reduce the influences of the environmental change, rocking, and the like, it is preferable (1) to use the ink residual amount by the ink residual amount detecting means as a detected value when the change ratio of the liquid level detected within a unit time is equal to or less than a predetermined design value, or (2) to detect the detected value as the ink residual amount of the stationary condition when the fluctuation width of the liquid level is converted in a predetermined range in a measurement time less than a predetermined time. Furthermore, in order to minimize the influences of the environmental change, rocking, and the like, the detected value which satisfies both the above (1) and (2) may be used as the ink residual amount.

The major part of the present invention has been described using the first embodiment of the present invention, but other embodiments to which the present invention can be applied will be described hereinafter. Additionally, it goes without saying that in the following embodiments and the above-described embodiment, combinable elements can arbitrarily be combined.

Second Embodiment

In the first embodiment, the detection of the ink residual amount in the ink tank with the deformable ink containing portion has been basically described, but in the present embodiment, the serial type ink jet recording apparatus to which the liquid supply system is applied will be described with respect to the ink residual amount detection when also considering the negative pressure condition of the negative pressure generating member containing chamber.

Figure 17:
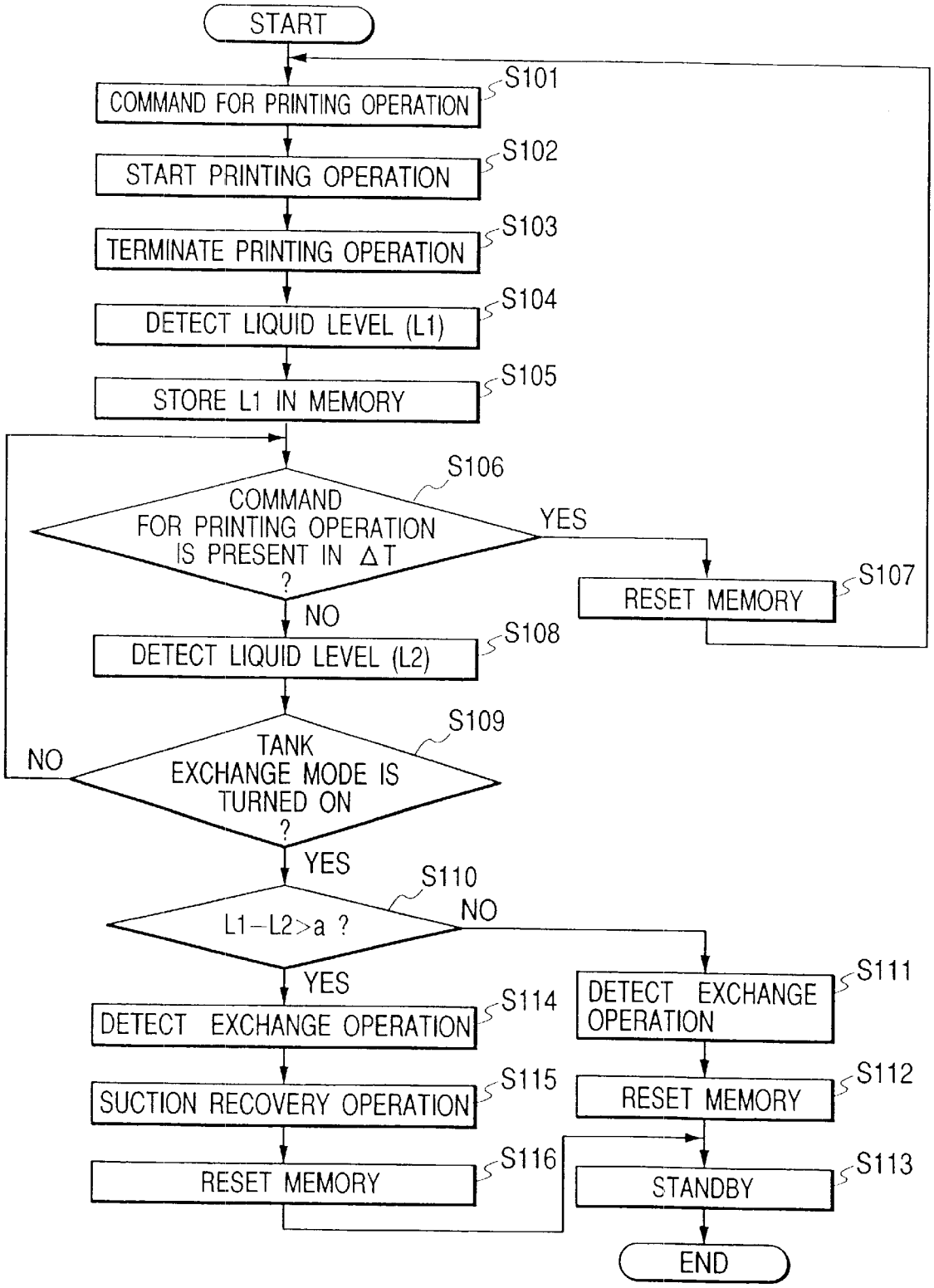
FIG. 17 is a flowchart showing an ink residual amount detecting method according to a second embodiment of the present invention.

FIG. 17 is a flowchart showing an ink residual amount detecting method according to a second embodiment of the present invention. Moreover, FIGS. 18A, 18B, 19A and 19B are sectional views showing the condition of the ink supply system for a part of the steps of the flowchart shown in FIG. 17. Additionally, since the ink supply system shown in FIGS. 18A, 18B, 19A and 19B is the same as that described in the first embodiment, the same reference numerals as those of the first embodiment are used. Additionally, the headed holder shown in FIGS. 18A, 18B, 19A and 19B is mounted on the carriage of the recording apparatus. Moreover, in the present embodiment, since the ink residual amount is detected in the home position of the carriage, the light emitting portion 81 constituting the ink residual amount detecting means is disposed in the home position of the carriage of the recording apparatus main body. The light receiving portion 82 may be attached to the top surface of the negative pressure generating member containing chamber 10 or the recording apparatus main body, but when the portion is attached to the recording apparatus main body, it is disposed in the home position in the same manner as the light emitting portion 81. When the light receiving portion 82 is attached to the recording apparatus main body, the headed holder 30 is not configured to surround the entire periphery of the ink tank 50, and is instead structured to have a notch or the like in one site via which the light receiving portion 82 can enter by the movement of the carriage. Here, the light receiving portion 82 attached to the top surface of the negative pressure generating member containing chamber 10 will be described.

Figure 18A:
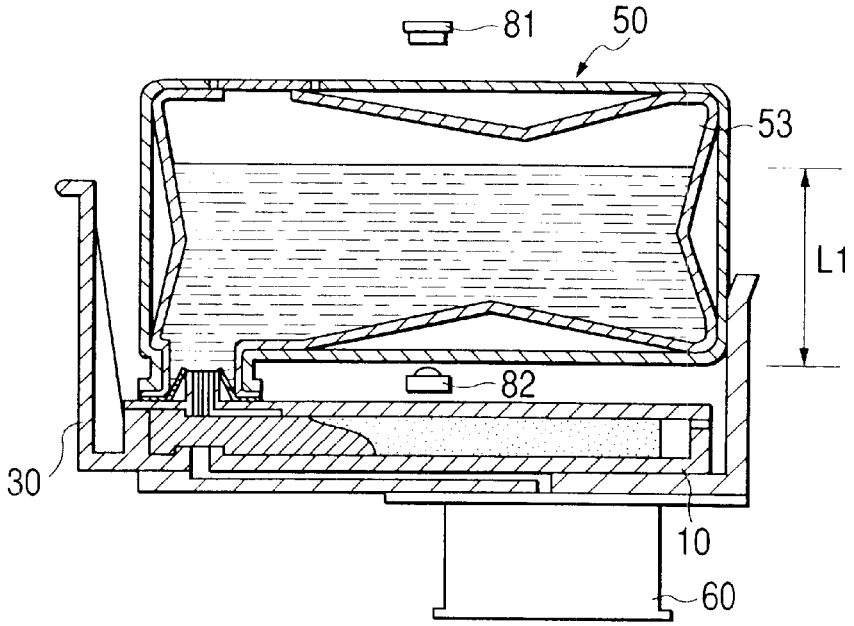
FIGS. 18A and 18B are explanatory views showing a major step of the flowchart shown in FIG. 17.

First, a command for printing operation is issued (S101), and the printing operation is started (S102). Subsequently, when the printing operation is terminated (S103), the carriage is moved to the home position, and as shown in FIG. 18A, liquid level L1 in the stationary condition of the ink containing portion 53 is detected as the ink residual amount by the light emitting portion 81 and the light receiving portion 82 (S104). Here, the reason why the stationary condition is detected is that, as described also in the first embodiment, the influence of the fluctuation of the liquid level by the carriage movement is reduced. When the liquid level L1 is detected, the detected value is stored in a memory (S105).

Subsequently, even while the apparatus is left to stand without performing the printing operation, the liquid level of the stationary condition is detected at a predetermined time interval. Here, it is judged whether or not the command for the printing operation is present in predetermined time AT which is the liquid level detecting interval time (S106).

Figure 18B:
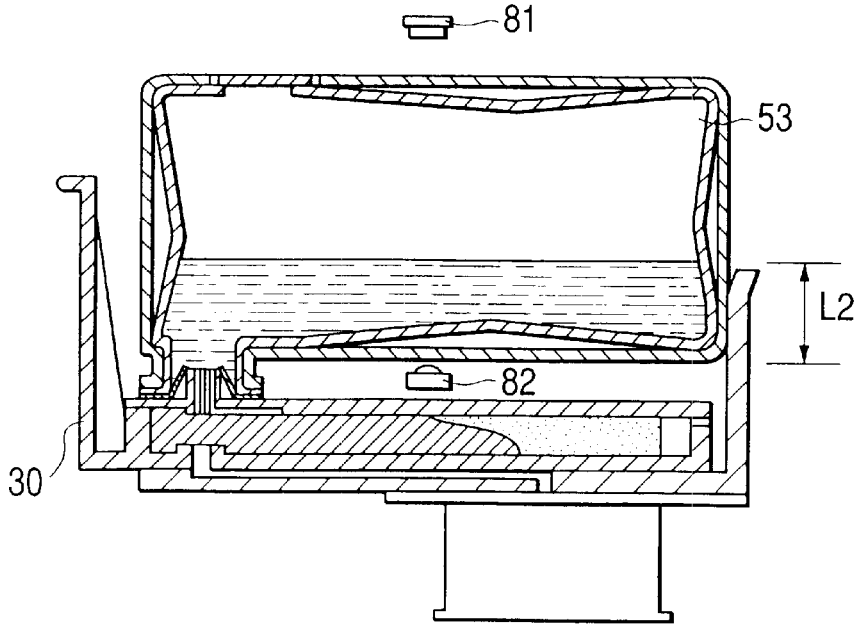

When the command is issued, the memory is reset (S107), and the printing operation is then started (S102). When no command for the printing operation is issued, as shown in FIG. 18B, a liquid level L2 in the stationary condition of the ink containing portion 53 is detected as the ink residual amount by the light emitting portion 81 and the light receiving portion 82 (S108).

When the liquid level L2 is detected, it is judged whether or not a tank exchange mode is turned on (S109). The tank exchange mode is turned on/off by the user as occasion demands, and when the tank exchange mode is off, the process returns to the step S106. On the other hand, when the tank exchange mode is on, the carriage is moved to the ink tank exchange position from the home position, difference L1–L2 between the liquid level L1 stored in the memory and the subsequently detected liquid level L2 is calculated, and it is judged whether or not the value is larger than a predetermined constant $\alpha$ ($\alpha$ is a positive value) (S110).

Although the printing operation is not performed, a difference is generated between the value of L1 and L2. This means that the ink moves between the ink containing portion 53 and the negative pressure generating member containing chamber 10 by the environmental change or the like. In the case in which L1–L2 results in a negative value, the ink residual amount in the ink containing portion 53 increases while the liquid level is detected twice. However, since the ink residual amount is not reduced, no influence is exerted in informing the time to exchange the ink tank 50. However, when L1–L2 results in a positive value, and when the ink containing portion 53 and the negative pressure generating member containing chamber 10 are balanced in the inner pressure after the exchange of the ink tank 50, the ink is excessively held in the negative pressure generating member containing chamber 10, and the inner pressure of the negative pressure generating member containing chamber 10 possibly becomes positive. When the inner pressure of the negative pressure generating member containing chamber 10 reaches the positive pressure, the ink leaks from the recording head 60.

To solve the problem, the above-described constant $\alpha$ is set to a value such that a slight ink movement to the negative pressure generating member containing chamber 10 from the ink containing portion 53 is permitted and that the negative pressure generating member containing chamber 10 does not attain the positive pressure after the exchange of the ink tank 50.

When the value of L1–L2 is equal to or less than the constant $\alpha$, the exchange operation of the ink tank 50 is detected (S111), the memory is reset (S112), and the recording apparatus is then on standby (S113).

Figure 19A:
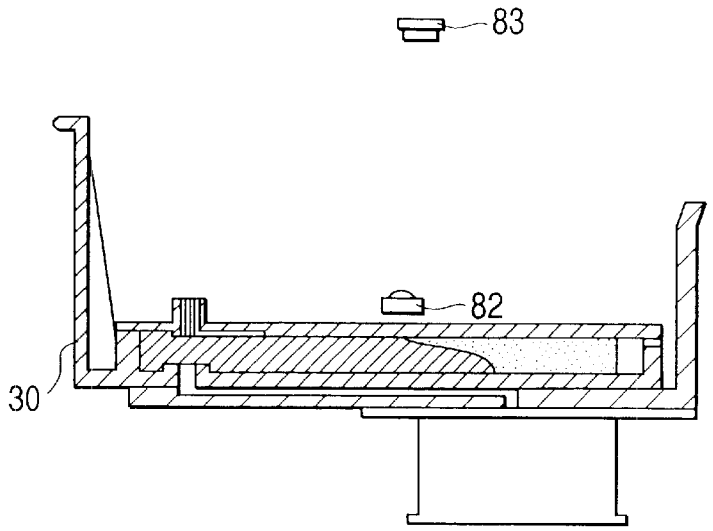
FIGS. 19A and 19B are explanatory views of the major step of the flowchart shown in FIG. 17.

Here, for the light receiving portion 82 constituting the ink residual amount detecting means disposed on the headed holder 30, when a light emitting portion separate from the light emitting portion 81 constituting the ink residual amount detecting means is disposed in the ink tank exchange position, it can be utilized to detect the exchange operation of the ink tank 50. Specifically, when the ink tank 50 is detached from the headed holder 30, as shown in FIG. 19A, the light emitted from a light emitting portion 83 is directly incident upon the light receiving portion 82. As a result, the light-receiving level of the light receiving portion 82 further becomes higher than when the ink is transmitted through the ink tank 50 containing no ink. Thereby, it is detected that the ink tank 50 is detached from the headed tank 30.

Subsequently, when a new ink tank 50 containing ink is attached, the light-receiving level of the light receiving portion 82 lowers, and it is thus detected that the new ink tank 50 is attached. Therefore, by checking the change of the light-receiving level of the light receiving portion 82, it can be known on the side of the recording apparatus whether the exchange operation of the ink tank 50 has been performed. In this manner, the ink residual amount detecting means of the present invention can also be used to detect the presence/absence of the attached ink tank 50, and the reliability can further be enhanced as the system.

Additionally, the exchange operation of the ink tank 50 may be detected by a switch or the like disposed on the headed tank 30 for detecting the presence/absence of the ink tank 50. Moreover, when the ink tank 50 can be exchanged without moving the tank from the home position, the light emitting portion 81 and the light receiving portion 82 of the ink residual amount detecting means can be utilized as they are to detect the exchange operation of the ink tank 50.

Figure 19B:
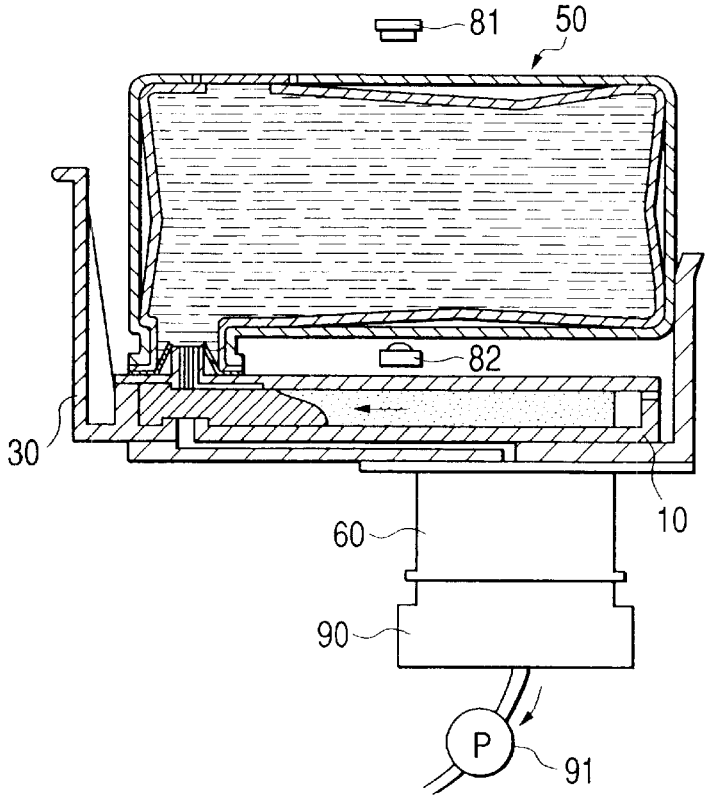

On the other hand, when the value of L1–L2 is larger than the constant a, the exchange operation of the ink tank 50 is detected as described above (S114), and a suction recovery operation of the recording head 60 is performed (S115) before the ink containing portion 53 and the negative pressure generating member containing chamber 10 are balanced in inner pressure. The suction recovery operation is performed by moving the carriage again to the home position, capping the recording head 60 with a cap 90 connected to a suction pipe 91 as shown in FIG. 19B, and sucking the ink via the recording head 60. By sucking the ink in this manner, the negative pressure is generated in the negative pressure generating member containing chamber 10, so that even when the cap 91 is removed, no ink leaks from the recording head 60.

As described above, by performing the suction recovery operation in accordance with the decrease amount of the ink in the detection of the ink residual amount in the ink containing portion 53 after the termination of the printing operation, the ink can securely be prevented from leaking from the recording head 60 with the exchange of the ink tank 50.

In the present embodiment, when there is a possibility that the negative pressure generating member containing chamber 10 attains the positive pressure after the exchange of the ink tank 50, the suction recovery operation is performed in order to prevent the ink from leaking from the recording head 60. This example has been described, but to avoid the ink consumption by the suction recovery, an alarm for prohibiting the ink tank exchange may be issued to the user on the side of the recording apparatus. In this case, when the ink tank exchange prohibiting alarm is issued, the process returns to the step S105 and the above-described operation is performed.

Third Embodiment

Figure 20:
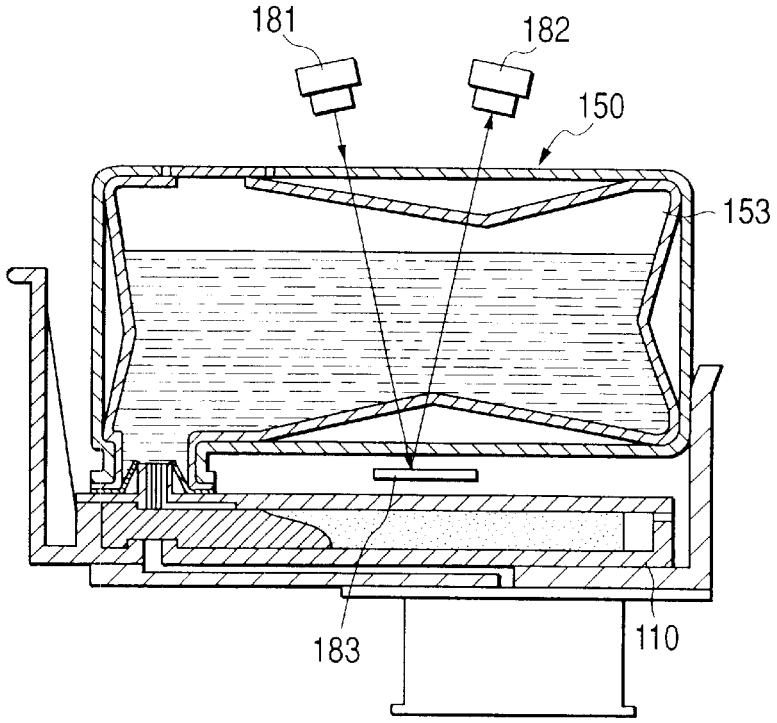
FIG. 20 is a sectional view showing an example in which the liquid supply system according to a third embodiment of the present invention is applied to the ink jet cartridge.

FIG. 20 is a sectional view of the liquid supply system according to a third embodiment of the present invention.

In the present embodiment, a light emitting portion 181 and a light receiving portion 182 are disposed above the ink tank 150, and a reflective plate 183 is disposed between the ink tank 150 and the negative pressure generating member containing chamber 110. The light emitted from the light emitting portion 181 is transmitted through the ink tank 150, then reflected by the reflective plate 183, again transmitted through the ink tank 150, and incident upon the light receiving portion 182. Subsequently, as described in the first and second embodiments, the ink residual amount in the ink containing portion 153 is detected in accordance with the light-receiving level of the light incident upon the light receiving portion 182.

By using the reflective plate 183 in this manner, the freedom degree of the layout of the light emitting portion 181 and the light receiving portion 182 is enhanced. Moreover, since the reflective plate 183 is thin, the space between the ink tank 150 and the negative pressure generating member containing chamber 110 can be minimized, thereby increasing the volume of the ink tank 150.

Fourth Embodiment

In the above-described embodiments, the change of the liquid level position is continuously detected by optical means to continuously detect the change of the ink residual amount, but the ink residual amount detecting means is not limited to the optical means as long as it is disposed above or below the ink containing portion and the change of the liquid level position can be detected.

Figure 21:
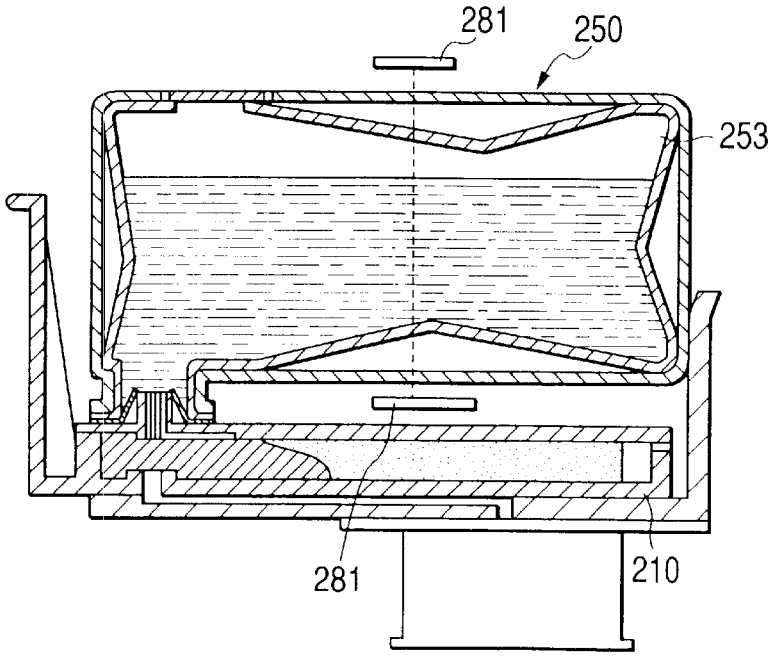
FIG. 21 is a sectional view showing an example in which the liquid supply system according to a fourth embodiment of the present invention is applied to the ink jet cartridge.

FIG. 21 is a sectional view of the ink supply system according to a fourth embodiment of the present invention in which the ink residual amount is detected by means other than the optical means.

As shown in FIG. 21, in the present embodiment, two electrodes 281 are disposed opposite to each other above an ink tank 250, and between the ink tank 250 and a negative pressure generating member containing chamber 210. In this case, the signals of sine wave and rectangular wave are inputted to these electrodes 281, and the continuous change of the electrostatic capacity between the electrodes 281 by the change of the liquid level position in the ink tank 250 is detected as the change of the ink residual amount in the ink tank 250. In this case, for example, when the rectangular wave signal is applied, the pulse voltage, pulse frequency, the number of pulses for stable detection, and the like are appropriately set. In the present embodiment, the change of the ink residual amount is grasped by the electrostatic capacity, not by the light-receiving level in the above-described embodiment, and the basic idea concerning the detection of the ink residual amount is similar to that of the above-described embodiment.

By utilizing the change of the electrostatic capacity to detect the ink residual amount in this manner, the ink residual amount can be detected, for example, even when the ink tank 250 does not transmit light, or even when the ink light transmittance to be detected is remarkably high, and the displacement of the liquid level position can be detected irrespective of the material of the ink tank 250 and the type of the contained ink.

Figure 22:
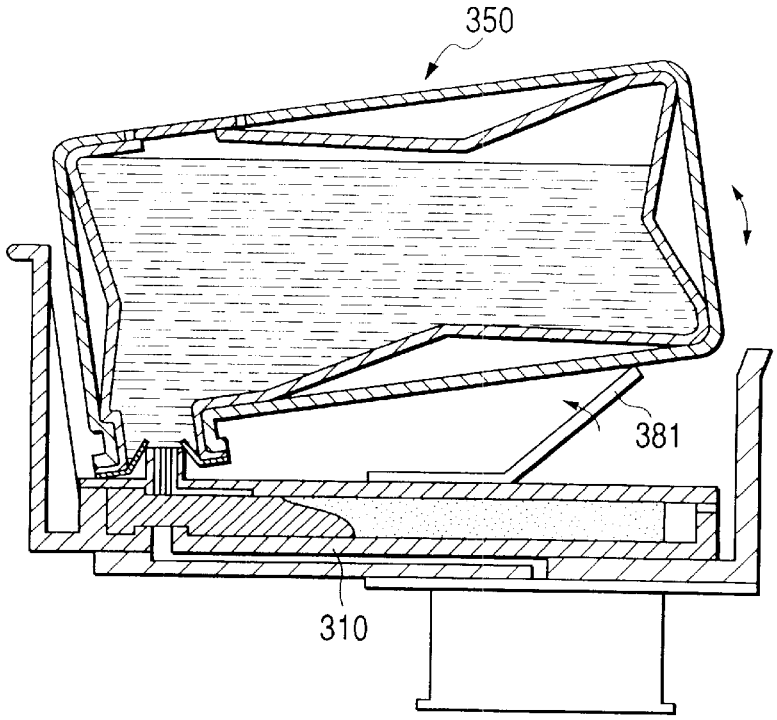
FIG. 22 is a sectional view of the ink jet cartridge according to a modification of the embodiment shown in FIG. 20 or 21.

Additionally, as shown in FIG. 22, in order to facilitate the detachment of an ink tank 350 during the exchange of the ink tank 350, a pop-up spring 381 for pushing the ink tank 350 upwardly is disposed on the top surface of a negative pressure generating member containing chamber 310. In the constitution, when the engagement of the ink tank 350 and the tank holder by engagement means (not shown) is released, the ink tank 350 is lifted up. In this case, this pop-up spring 381 can be used in a combined manner with one of the reflective plate 183 in the above-described third embodiment (see FIG. 20) and the electrode 281 in the present embodiment (see FIG. 21).

The pop-up spring 381 may be constituted of a metal or a resin as long as the spring is provided with sufficient elasticity and repeated restoring properties. When the spring is constituted of the metal, the pop-up spring 381 can be utilized as the above-described reflective plate or the electrode as it is. Moreover, even when the spring is constituted of the resin, it can also be used as the ink residual amount detecting means by integrally molding or applying the reflective plate or the electrode to the surface of the spring.

By using the pop-up spring 381 in the combined manner with the reflective plate or the electrode in this manner, additional optical means or electrode may only be disposed above the ink tank 350 as the ink residual amount detecting means, so that the freedom degree of the design of the ink supply system can also be enhanced.

Fifth Embodiment

Figure 23:
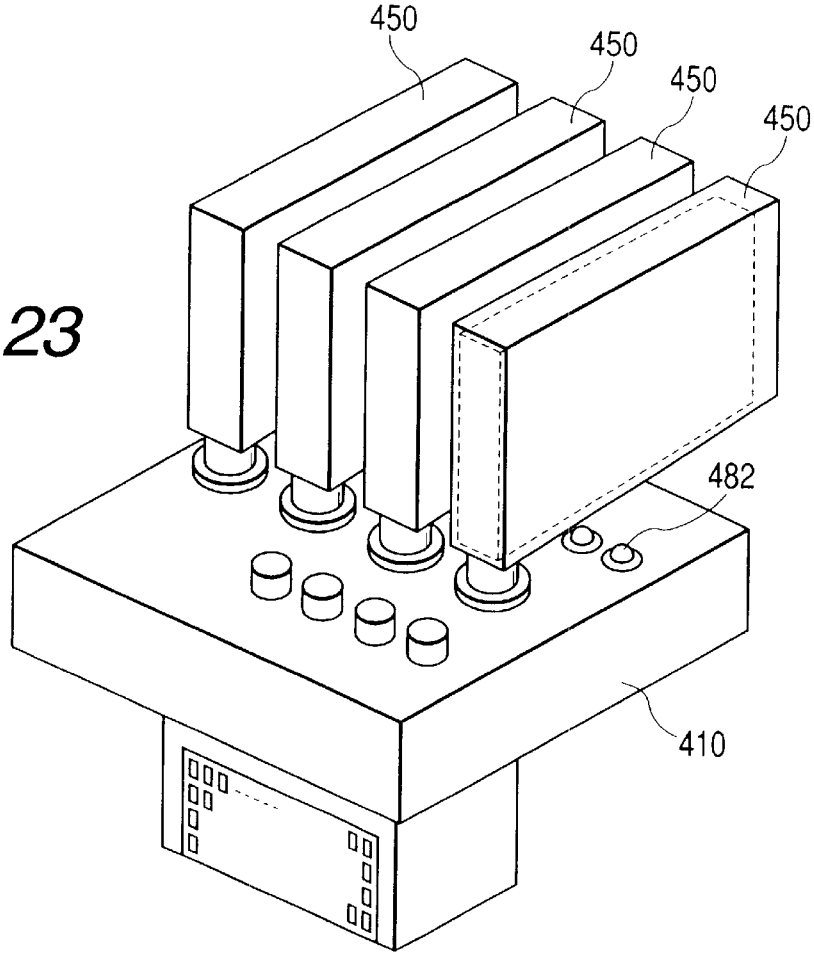
FIG. 23 is a perspective view showing an example in which the liquid supply system according to a fifth embodiment of the present invention is applied to the ink jet cartridge.

FIG. 23 is a perspective view of the ink supply system according to a fifth embodiment of the present invention.

The present embodiment is applied to a color ink jet cartridge, and four ink tanks 450 are detachably held in a negative pressure generating member containing chamber 410. The ink tanks 450 are constituted in the same manner as the ink tanks of the above-described embodiments, and contain different color inks. The negative pressure generating member containing chamber 410 is divided in four chambers for the ink tanks 450, and negative pressure generating members (not shown) are contained in the chambers, respectively. A recording head is integrally disposed on the lower portion of the negative pressure generating member containing chamber 410.

Moreover, in the present embodiment, the ink residual amount in the ink tank 450 is optically detected, and light receiving portions 482 constituting the ink residual amount detecting means are disposed on the sites of the upper surface of the negative pressure generating member containing chamber 410 below the ink tanks 450. A light emitting portion (not shown) for radiating light to the light receiving portion 482 is disposed above the ink tank 450. When a plurality of ink tanks 450 are arranged like in the present embodiment, one light emitting portion may be used in common with the light receiving portions 482, instead of disposing the light emitting portion for each light receiving portion 482.

As described above, when a plurality of ink tanks 450 are disposed, by using the light emitting portion in common, the number of components decreases and the structure can be simplified.

Additionally, when the light emitting portion is used in common, it is preferable to devise the shape of the tank holder, for example, by partitioning the ink tanks 450, so that the light incident upon each light receiving portion 482 is prevented from being influenced by the adjacent ink tank 450. Moreover, in the present invention, the example of the light receiving portion 482 disposed on the negative pressure generating member containing chamber 410 has been described, but the light receiving portion may of course be disposed for each ink tank 450 on the side of the recording apparatus main body.

Sixth Embodiment

Figure 24:
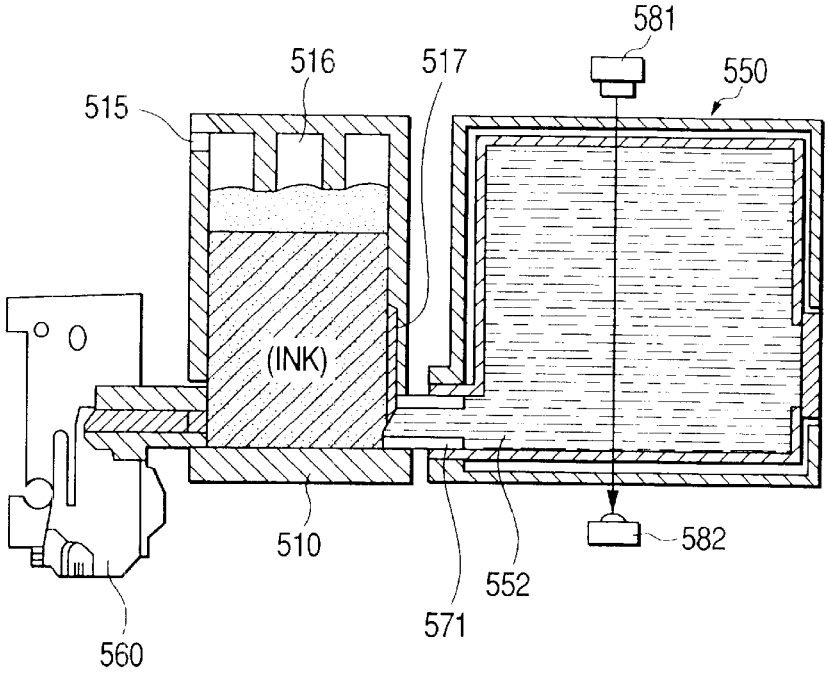
FIG. 24 is a sectional view showing an example in which the liquid supply system according to a sixth embodiment of the present invention is applied to the ink jet cartridge.

FIG. 24 is a sectional view of the ink supply system according to a sixth embodiment of the present invention.

In the present embodiment, an ink tank 550 is disposed beside a negative pressure generating member containing chamber 510 connected to a recording head 560. The negative pressure generating member is contained in the negative pressure generating member containing chamber 510, a buffer portion 516 is formed in the upper space of the chamber, and an atmosphere connecting port 515 is disposed in the top end portion of the negative pressure generating member containing chamber 510. The negative pressure generating member containing chamber 510 is also provided with a connecting tube 571 for connection to an ink supply, portion 552 of the ink tank 550, and an atmosphere introducing groove 517 connected to the connecting tube 571 is formed upward in the inner wall surface of the negative pressure generating member containing chamber 510. The constitution of the ink tank 550 is similar to that of the first embodiment.

Furthermore, the ink residual amount detecting means for detecting the ink residual amount in the ink tank 550 is optical means similar to that of the first embodiment, and is constituted of a light emitting portion 581 disposed above the ink tank 550 and a light receiving portion 582 disposed below the ink tank 550.

Even when the ink tank 550 and the negative pressure generating member containing chamber 510 are arranged in a lateral direction in this manner, the ink residual amount in the ink tank 550 can be detected in the same manner as in the first and second embodiments. Moreover, since the light receiving portion 582 does not need to be disposed between the ink tank 550 and the negative pressure generating member containing chamber 510, no space is necessary for the light receiving portion 582 between the ink tank 550 and the negative pressure generating member containing chamber 510. Additionally, even when the ink tank 550 and the negative pressure generating member containing chamber 510 are arranged in the lateral direction, the ink residual amount detecting means can be constituted similarly to that of the third or fourth embodiment.

Other Embodiments

The embodiments of the present invention have been described above, but other embodiments applicable to the above embodiments and embodiment modifications will be described hereinafter. Additionally, the following can be applied to the above-described embodiments unless otherwise mentioned.

<Structure of Capillary Force Generating Member Containing Chamber>

The structure of a capillary force generating member containing chamber in each above embodiment will first be supplemented/described.

As a capillary force generating member to be contained in the capillary force generating member containing chamber (capillary force generating member container), a porous member of polyurethane foam or the like, a felt-like fiber member, a thermally molded fiber lump, and the like can be used.

For the connecting tube, the tubular member has been described, but any configuration may be used as long as it does not inhibit the gas-liquid exchange in the gas-liquid exchange condition.

Moreover, in the above-described embodiments, the space (buffer portion) with no capillary force generating member is disposed in the vicinity of the end portion opposite the connecting tube, but in the usual condition the space may be filled with the capillary force generating member holding no liquid. When the capillary force generating member holding no liquid is present in the buffer space, the ink which has moved to the capillary force generating member containing chamber during the above-described environmental change can be held.

Furthermore, in the above-described embodiments the atmosphere introducing groove is disposed in the inner surface of the housing, but does not have to be necessarily disposed.

However, when the atmosphere introducing groove is disposed as the structure for promoting the gas-liquid exchange, the above-described gas-liquid interface can easily be formed, and more stable ink supply can advantageously be realized. Specifically, the liquid supply operation to the outside like the recording head is stabilized. Additionally, for the design of the capillary force generating member and the ink containing portion, there are conditions in the supply conditions such as the first supply condition and the second supply condition as described above. Therefore, by forming the gas-liquid interface, these conditions can further easily be considered.

<Structure of Ink Tank>

The structure of the ink tank in the above-described embodiments will next be supplemented/described.

When the ink tank can be attached to or detached from the capillary force generating member, the seal member for preventing the liquid or the air from leaking from the connecting portion during the connection and for preventing the ink in the ink containing portion from being introduced out before the connection is disposed in the connecting portion of the ink tank with the capillary force generating member containing chamber. In each of the embodiments, the film-like seal member is used, but a ball-like stopper or the like may be used. Moreover, the connecting tube may comprise a hollow needle, and the seal member may comprise a rubber stopper.

Moreover, the ink tanks of the above-described embodiments are formed by a direct blow manufacture method. Specifically, a housing (outer wall) and an ink containing portion (inner wall) which can be separated from each other are formed by uniformly expanding a cylindrical parison in a substantially polygon columnar mold by air blow. Instead, for example, by disposing a metal spring or the like in a flexible bag, the negative pressure may be generated when the ink is introduced.

However, there are advantages in the use of the blow molding that the ink containing portion having an outer surface shape equal to or complementary to a housing inner surface shape can easily be manufactured and that the negative pressure to be generated can easily be set by changing the material and thickness of the inner wall constituting the ink containing portion. Furthermore, when a thermoplastic resin is utilized in the material of the inner wall and the outer wall, an ink tank superior in recycling properties can be provided.

Here, the result structure of the structure of "outer wall" and the "outer wall" in the above-described embodiments to the "inner wall" will be supplemented/described.

In the above-described embodiments, since the ink tank is manufactured by blow molding, for the inner wall, the thickness in the vicinity of the corner portion is formed to be smaller than the thickness of the region in the vicinity of the center of the face constituting the container. Moreover, similarly for the outer wall, the thickness in the vicinity of the corner portion is formed to be smaller than the thickness of the region in the vicinity of the center of the face constituting the container. Furthermore, for the inner wall to the outer wall, the inner wall is formed by laminating the inner wall on the outer wall which has a thickness distribution in which the thickness gradually decreases toward the corner portion of each face from the central portion of each face.

As a result, the inner wall has the outer surface which agrees with the inner surface of the outer wall. Since the outer surface of the inner wall runs along the thickness distribution of the outer wall, the outer surface protrudes toward the ink containing portion formed by the inner wall. Furthermore, since the inner surface of the inner wall has the above-described thickness distribution of the inner wall, the inner surface further protrudes toward the ink containing portion. In the structure, since the above-described function is fulfilled particularly in the maximum area portion, in the present invention, such protruded shape may be present at least in the maximum area portion, and the protruded shape may be 2 mm or less on the inner wall surface, and 1 mm or less on the inner wall outer surface. The protruded shape is sometimes within a measurement error range in the small area portion, but the protruded shape forms one factor for giving a deformation priority in each face of the substantially polygon columnar ink tank, and therefore forms one of the preferable conditions for the present invention.

Additionally, the structure of the outer wall will be supplemented. As one function of the above-described outer wall, the deformation of the corner portion of the inner wall is regulated, and the structure for fulfilling the function is not limited as long as the shape can be maintained against the inner wall deformation and the periphery of the corner portion is covered (corner portion surrounding member). Therefore, in the structure, the above-described outer wall or the inner wall may be covered with the materials such as plastic, metal and cardboard. As the outer wall, the entire may be formed of faces, only the corner portion may have a face structure, or the face structure may be bonded with a metal rod. Furthermore, the outer wall may be of a mesh structure.

Figure 25:
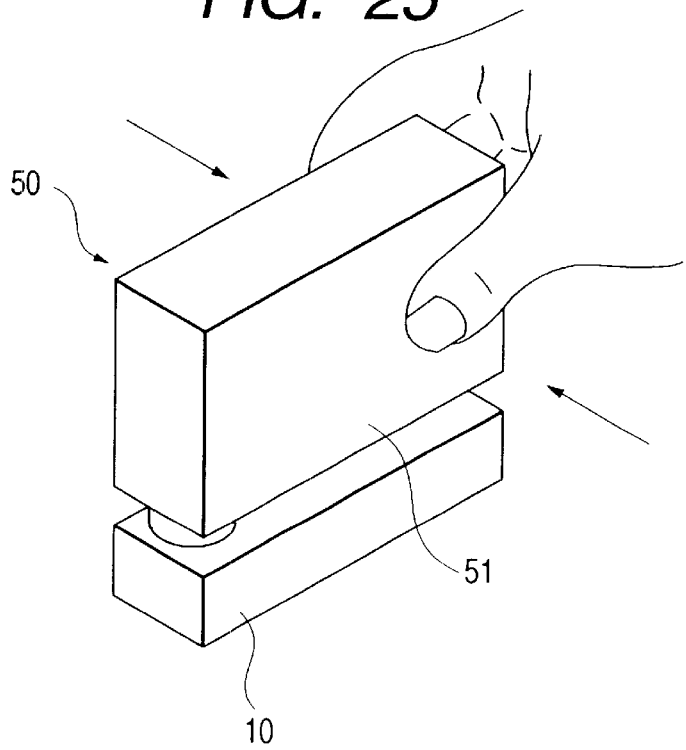
FIG. 25 is a schematic perspective view of the ink tank and a negative pressure generating member containing chamber, showing an example of a manual pressure recovery processing method when the ink runs out in a negative pressure generating member.

Furthermore, the ink runs out from the gas-liquid exchange path vicinity region to the ink supply port vicinity region of the negative pressure generating member for some reason during the exchange of the ink tank when the ink tank is of an exchangeable type. In this case, for example, as shown in FIG. 25, by manually temporarily pressing the elastically deformable outer wall 51 together with the inner wall to forcibly move the ink of the ink tank 50 to the capillary force generating member containing chamber 10, the ink can easily be recovered. Such pressurizing recovery processing may automatically be performed, not manually, and the pressurizing recovery means may be disposed on the recording apparatus described later. Additionally, when a part of the inner wall is exposed, only the exposed portion of the inner wall may be pressed.

Additionally, in the embodiments of the present invention, the ink containing portion has the substantially polygon columnar shape, but is not limited to this configuration, and any configuration can achieve the object of the present invention as long as the portion can be deformed at least with the introduction of the ink and the negative pressure can be generated by the deformation.

Furthermore, in order to obtain the buffer effect by the above-described ink containing portion, the ink containing portion needs to be elastically deformable and returnable to the shape before the deformation by the expansion of the content of the portion. Specifically, the portion is requested to be deformed in an elastic deformation range. If the proportion of the negative pressure change with the deformation by the ink introduction rapidly changes (e.g., when the deformed portions abut on each other), it is preferable even in the elastic deformation range to complete the first ink supply condition and start the second ink supply condition before this rapid change condition.

Moreover, the material for use in the liquid container which is applied to the present invention is not limited as long as the inner wall and the outer wall can be separated, and a plurality of materials may be used in the inner wall or the outer wall to form a multilayered constitution. Furthermore, the material with a higher elasticity can be used in the inner wall as compared with when the ink containing chamber is used alone as the negative pressure generating type liquid container. When the influence on the ink contained inside or the like is considered, for example, a polyethylene resin, a polypropylene resin, and the like can preferably be applied.

<Liquid Supply Operation and Ink Supply System>

The liquid supply operation and the ink supply system will next be supplemented/described.

The ink supply operation in the ink supply system of the above-described embodiments is subjected to the initial condition in which the ink tank and the capillary force generating member containing chamber are not connected, the operation start condition in which they are connected, and the first and second ink supply conditions.

Here, as a first modification of the above-described embodiments, the ink supply system having no gas-liquid exchange condition, that is, the second ink supply condition also has a step of using the ink of the ink containing portion without introducing the outside air into the ink containing portion. Therefore, the internal volume of the liquid container may be limited by considering only the air introduced into the ink containing portion during the connection. Specifically, even when the limitation of the internal volume of the ink tank is moderated, the constitution has an advantage that the environmental change can be handled. However, when the operation efficiency of the ink containing portion is considered, the ink of the ink containing portion can more easily be consumed in the above-described embodiments in which the gas-liquid exchange condition follows the first ink supply condition.

As a second modification, the consumption speed at which the ink is consumed via the recording head is remarkably small. In this case, both negative pressures are not always balanced in the first supply condition, the ink of the capillary force generating member containing chamber is preferentially consumed until the difference between both negative pressures reaches a predetermined value or more, and the ink of the ink containing portion moves toward the capillary force generating member containing chamber when the difference of the negative pressure becomes constant or more.

Additionally, in the ink tank in which the above-described two chambers are always integrally constituted, the operation start condition is completed in the stage of the operation start, but with respect to the other effects of each supply operation, the effects of the embodiments can be applied as they are. also in the modification.

<Liquid Discharge Recording Apparatus>

Figure 26:
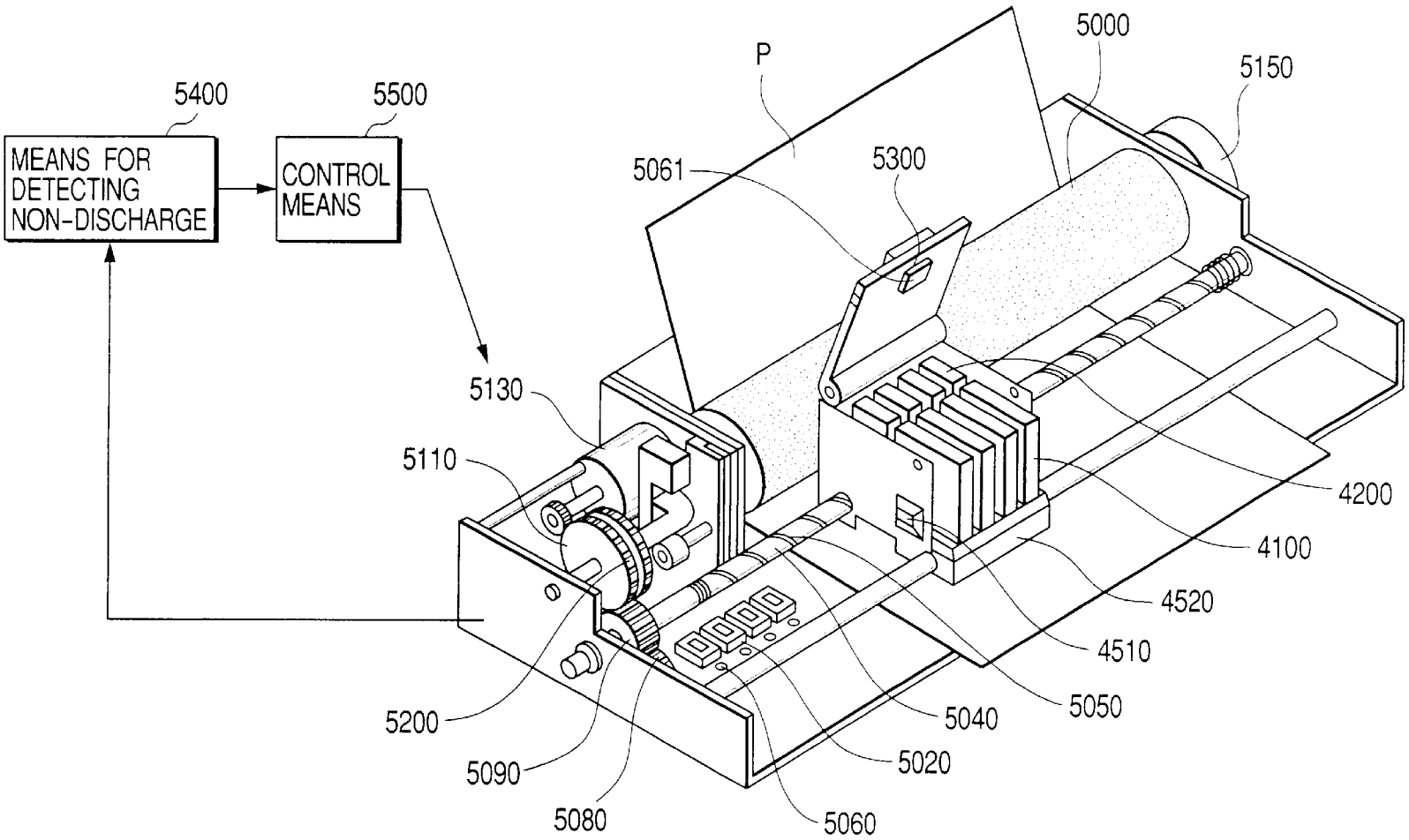
FIG. 26 is a schematic explanatory view showing one example of an ink jet recording apparatus to which the liquid supply system of the present invention can be applied.

Finally, an ink jet recording apparatus will be described in which the ink tank of the embodiment of the present invention shown in FIG. 1 is mounted to perform recording. FIG. 26 is a schematic view of the ink jet recording apparatus to which the liquid supply system of the embodiment of the present invention is applied.

The ink jet recording apparatus shown in FIG. 26 for recording a color image comprises a head unit provided with a recording head (refer to the headed holder 30 of FIG. 1, which is not shown in FIG. 26). The head unit comprises four negative pressure generating member containing chambers 4200 and four ink tanks 4100 for holding ink to be supplied to the negative pressure generating member containing chambers 4200, which are integrally disposed for ink colors. These negative pressure generating member containing chambers 4200 and the ink tanks 4100 are fixed/ supported on an ink jet recording apparatus main body by positioning means (not shown) of a carriage 4520 and a connecting plate 5300 rotating around a predetermined axis, and detachably attached to the carriage 4520.

The forward/reverse rotation of a drive motor 5130 is transmitted to a lead screw 5040 via drive transmission gears 5110, 5090 to rotate the lead screw, and the carriage 4520 has a pin (not shown) which is engaged with a helical groove 5050 of the lead screw 5040. Thereby, the carriage 4520 is reciprocated/moved in the longitudinal direction of the apparatus.

On the other hand, a recording material P is fed below the carriage 4520 by the rotation of a conveying roller 5000 which is driven by a sheet feeding motor 5150. In this position, while the carriage 4520 is moved in the apparatus longitudinal direction, the ink is discharged from the recording head to perform the recording on the recording material P.

Caps 5020 for capping the front surfaces of the recording heads in the head unit are used to perform the suction recovery of the recording head via openings in the caps by suction means (not shown). The cap 5020 is moved by a drive force transmitted via a gear 5080, and the like to cover the discharge port face of each recording head. A cleaning blade (not shown) is disposed in the vicinity of the caps 5020, and the blade is supported so that it can move in the vertical direction of FIG. 26. The blade is not limited to this configuration and, needless to say, a known cleaning blade can be applied to this example.

These capping, cleaning, and suction recovery are constituted so that when the carriage 4520 moves to the home position, a desired processing can be performed in the corresponding position by the action of the lead screw 5040. These operations can be applied to this example as long as the desired operation is performed at a known timing.

Here, the advantages of the present invention applied to the ink jet recording apparatus having the reciprocating/moving carriage will be described.

In the present invention, since the ink containing chamber of the ink tank is a deformable member, the rocking of the ink by the scanning of the carriage can be moderated by the deformation of the ink containing chamber. To prevent the fluctuation of the negative pressure from being generated by the carriage scanning, a part of the corner portion of the ink containing portion is not detached from the corresponding housing inner surface. Even when the part is detached, the part is preferably positioned in the vicinity. Moreover, for the ink containing portion of the embodiment having a pair of opposite maximum area faces, by mounting the opposite maximum area faces on the carriage in the direction substantially orthogonal to the carriage scanning direction, the effect of moderating the ink rocking can further effectively be produced, and the accuracy in detecting the ink residual amount can further be enhanced.

Moreover, as described in the paragraph <Structure of Ink Containing Chamber>, pressurizing recovery means 4510 for pressurizing the inner wall via the outer wall of the ink containing chamber may be mounted on the recording apparatus.

Furthermore, in order to detect the ink residual amount in each ink tank 4100 in the home position, the connecting plate 5300 is provide with a light emitting portion 5061, and light receiving portions 5060 are disposed in the vicinity of the caps 5020. In this case, when non-discharge detecting means 5400 for detecting the non-discharge of the recording head and control means 5500 are further disposed, for example, by employing the following sequence, the ink run-out can be eliminated from the gas-liquid exchange path vicinity region to the ink supply port vicinity region of the capillary force generating member.

First, in the exchange of the ink containing chamber, when the non-discharge is detected in the head nozzle corresponding to the exchanged ink containing chamber after the usual suction recovery processing utilizing the caps 5020, the usual condition can be recovered by performing the pressurizing recovery operation by the pressurizing recovery means 4510. Moreover, the condition of "the presence of ink" is detected during the operation, the "non-discharge" condition of the corresponding head nozzle is detected by the non-discharge detecting means, and the non-discharge cannot be solved by the usual suction recovery processing. Even in this case, by performing the pressurizing recovery operation by the pressurizing recovery means 4510, the usual condition can be recovered. In either case, it is preferable to cap the recording head portion corresponding to the ink tank subjected to the pressurizing recovery with the cap and to prevent the ink from inadvertently leaking from the recording head portion.

Additionally, the light emitting portion 5061 and the light receiving portions 5060 have been described as the ink residual amount detecting means, but like in the above-described embodiments, the light emitted from/ the light emitting portion 5061 may be reflected by the. reflective plate and guided to the light receiving portion 5060, and means other than the optical means, such as the means utilizing the electrostatic capacity, may be used.

As described above, according to the present invention, in the liquid supply system comprising the liquid residual amount detecting means for detecting the liquid level position of the liquid in the liquid containing portion which can be deformed to generate the negative pressure, so that the liquid is introduced to the negative pressure generating member containing chamber from the liquid containing chamber having the above-described liquid containing portion, the residual amount of the contained liquid can steadily be detected. The residual amount can be detected more steadily particularly when the gas-liquid exchange is performed between the liquid containing portion and the negative pressure generating member containing chamber. Moreover, since the residual amount situation of the liquid in the liquid containing portion can be grasped, in the liquid containing chamber and the negative pressure generating member containing chamber which can be detachably attached and can be exchanged, the time to exchange the liquid containing chamber can easily be presented to the user.

As the liquid residual amount detecting means, the optical detecting means, the electrostatic capacity detecting means, and the like can be used, but by using the electrostatic capacity detecting means, the liquid level position of the liquid in the liquid containing portion can be detected irrespective of the material of the liquid containing chamber and the type of the liquid to be contained inside.

Moreover, in the liquid residual amount detecting method of the present invention, particularly comprising detecting the liquid level position of the liquid in the liquid containing portion even while no liquid is supplied to the outside from the negative pressure generating member containing chamber, and forcibly sucking a part of the liquid from the liquid supply portion after the exchange of the liquid containing chamber when as a result of detection it is judged that the residual amount is less than that of the previous result by a predetermined value or more, the liquid can securely be prevented from leaking from the liquid supply portion after the exchange of the liquid containing chamber even when excess liquid is held in the negative pressure generating member containing chamber by the environmental change, and the like.

What is claimed is:

1. A liquid supply system comprising:

a negative pressure generating member containing chamber provided with a liquid supply portion for supplying liquid outside of the chamber and an atmosphere connecting portion for connecting with atmosphere for containing a negative pressure generating member holding the liquid inside;

a liquid containing chamber connected to said negative pressure generating member containing chamber, forming an enclosure except the connection, and having a liquid containing portion which can generate a negative pressure by deformation; and liquid residual amount detecting means for detecting a liquid level position of the liquid in said liquid containing portion to detect a liquid residual amount in said liquid containing portion.

2. The liquid supply system according to claim 1, wherein said liquid residual amount detecting means detects the liquid level position of the liquid in said liquid containing portion while outside air is introduced to said liquid containing portion from said atmosphere connecting portion via said negative pressure generating member containing chamber and causing gas-liquid exchange to move the liquid in said liquid containing chamber to said negative pressure generating member containing chamber to supply the liquid to the outside.

3. The liquid supply system according to claim 1 wherein said liquid containing chamber is constituted of a material for transmitting light, and said liquid residual amount detecting means comprises optical detecting means for optically detecting the liquid level position of the liquid in said liquid containing portion.

4. The liquid supply system according to claim 3 wherein said optical detecting means comprises: a light emitting portion for emitting light; and a light receiving portion for detecting light amount of the light radiated from the light emitting portion and passed through said liquid containing chamber, said light emitting portion and said light receiving portion being disposed opposite to each other in a vertical direction via said liquid containing chamber.

5. The liquid supply system according to claim 4 wherein said light receiving portion is disposed on the top surface of said negative pressure generating member containing chamber.

6. The liquid supply system according to claim 4 comprising: a plurality of said negative pressure generating members and a plurality of said liquid containing chambers;

the same number of said light receiving portions corresponding to the number of said liquid containing chambers; and said light emitting portion in common with said liquid containing portions.

7. The liquid supply system according to claim 3 wherein said optical detecting means comprises a light emitting portion disposed above said liquid containing chamber for emitting light, a reflective plate disposed below said liquid containing chamber for reflecting the light emitted from the light emitting portion and passed through said liquid containing chamber, and a light receiving portion for detecting light amount of the light reflected by the reflective plate.

8. The liquid supply system according to claim 7 wherein said negative pressure generating member containing chamber is disposed below said liquid containing chamber so that the negative pressure generating member containing chamber can be separated from said liquid containing chamber, a biasing spring is disposed on the top surface of said negative pressure generating member containing chamber for pushing said liquid containing chamber upward to facilitate the separation of said negative pressure generating member and said liquid containing chamber, and the biasing spring also serves as said reflective plate.

9. The liquid supply system according to claim 1 wherein said liquid residual amount detecting means comprises electrostatic capacity detecting means for detecting electrostatic capacity in the vertical direction of said liquid containing chamber.

10. The liquid supply system according to claim 9 wherein said electrostatic capacity detecting means comprises a pair of electrodes disposed opposite to each other in the vertical direction via said liquid containing chamber.

11. The liquid supply system according to claim 10 wherein said negative pressure generating member is disposed below said liquid containing chamber so that the negative pressure generating member can be separated from said liquid containing chamber, a biasing spring is disposed on the top surface of said negative pressure generating member containing chamber for pushing said liquid containing chamber upward to facilitate the separation of said negative pressure generating member and said liquid containing chamber, and the biasing spring also serves as the electrode disposed below said liquid containing chamber among said pair of electrodes.

12. The liquid supply system according to claim 1 wherein said negative pressure generating member containing chamber and said liquid containing chamber are disposed to be separable from each other.

13. A liquid residual amount detecting method for detecting a liquid residual amount in a liquid containing chamber of a liquid supply system comprising a negative pressure generating member containing chamber provided with a liquid supply portion for supplying liquid outside of the chamber and an atmosphere connecting portion for connecting with atmosphere for containing a negative pressure generating member holding inside the liquid, and the liquid containing chamber connected to said negative pressure generating member containing chamber and having a liquid containing portion forming an enclosure except the connection and able to generate a negative pressure by deformation, comprising:

a first liquid supply step of deforming said liquid containing portion to generate the negative pressure and reducing the volume of said liquid containing portion, and moving the liquid in said liquid containing portion to said negative pressure generating member to supply the liquid outside of the chamber without introducing outside air into said liquid containing chamber from said atmosphere connecting portion via said negative pressure generating member containing chamber;

a second liquid supply step subsequent to said first liquid supply step of introducing the outside air to said liquid containing portion and causing gas-liquid exchange to move the liquid in said liquid containing chamber to said negative pressure generating member containing chamber so that the liquid is supplied to the outside; and a liquid level position detecting step of detecting a liquid level position of the liquid in said liquid containing portion during said second liquid supply step to detect the liquid residual amount in said liquid containing portion.

14. A liquid residual amount detecting method for detecting a liquid residual amount in a liquid containing chamber of a liquid supply system comprising a negative pressure generating member containing chamber provided with a liquid supply portion for supplying liquid outside of the chamber and an atmosphere connecting portion for connecting with atmosphere for containing a negative pressure generating member holding inside the liquid, and the liquid containing chamber detachably connected to said negative pressure generating member containing chamber and having a liquid containing portion forming an enclosure except the connection and able to generate a negative pressure by deformation, comprising:

a liquid level position detecting step of detecting a liquid level position of the liquid in said liquid containing portion at a predetermined time interval in a period when no liquid is supplied to the outside from said negative pressure generating member containing chamber; and a suction step of forcibly sucking a part of the liquid held by said negative pressure generating member from said liquid supply portion after said liquid containing portion is exchanged when a difference between the liquid level position detected in said liquid level position detecting step and the liquid level position detected in the previous liquid level position detecting step is lower than a predetermined value.

15. The liquid residual amount detecting method according to claim 14 wherein said predetermined value is a value at which a positive pressure is not attained in said negative pressure generating member containing chamber after said liquid containing chamber is exchanged.

16. The liquid residual amount detecting method according to claim 14 wherein the detecting of the liquid level position in said liquid containing portion comprises detecting light amount of light passed through said liquid containing chamber in a vertical direction.

17. The liquid residual amount detecting method according to claim 14 wherein the detecting of the liquid level position in said liquid containing portion comprises detecting electrostatic capacity in a vertical direction of said liquid containing chamber.

* * * * *

UNITED STATES PATENT AND TRADEMARK OFFICE

CERTIFICATE OF CORRECTION

PATENT NO. : 6,422,674 B1
DATED : July 23, 2002
INVENTOR(S) : Jun Hinami et al.

It is certified that error appears in the above-identified patent and that said Letters Patent is hereby corrected as shown below:

Column 3,
Line 6, “inventors” should read -- inventors’ --.

Column 8,
Line 17, “recording. head” should read -- recording head --.

Column 16,
Line 5, “s” should read -- a --.

Column 21,
Line 29, “the. tip” should read -- the tip --.

Column 25,
Line 22, “arbitrarily” should read -- arbitrarily be --.

Column 26,
Line 66, “AT” should read -- ΔT --.

Column 31,
Line 3, “supply,” should read -- supply --.

Column 34,
Line 50, “are. also” should read -- are also --.

Column 36,
Line 25, “from/” should read -- from --; and
Line 25, “by the.” should read -- by the --.

Signed and Sealed this

Fourth Day of February, 2003

JAMES E. ROGAN
*Director of the United States Patent and Trademark Office*